US011857856B2

(12) United States Patent
Kapsalis

(10) Patent No.: US 11,857,856 B2
(45) Date of Patent: Jan. 2, 2024

(54) SPORTS GOAL BACKSTOP SYSTEM

(71) Applicant: Jeffrey Christian Kapsalis, Shelburne, VT (US)

(72) Inventor: Jeffrey Christian Kapsalis, Shelburne, VT (US)

( * ) Notice: Subject to any disclaimer, the term of this patent is extended or adjusted under 35 U.S.C. 154(b) by 123 days.

(21) Appl. No.: 17/458,919

(22) Filed: Aug. 27, 2021

(65) Prior Publication Data

US 2022/0062726 A1 Mar. 3, 2022

Related U.S. Application Data

(60) Provisional application No. 63/071,458, filed on Aug. 28, 2020.

(51) Int. Cl.
*A63B 63/00* (2006.01)
*A63B 71/02* (2006.01)

(52) U.S. Cl.
CPC ..... *A63B 63/004* (2013.01); *A63B 71/022* (2013.01)

(58) Field of Classification Search
CPC ..... A63B 71/022
See application file for complete search history.

(56) References Cited

U.S. PATENT DOCUMENTS

| | | | | |
|---|---|---|---|---|
| 4,063,739 | A * | 12/1977 | La Rose | A63B 71/022 473/421 |
| 5,902,194 | A * | 5/1999 | Wade | A63B 63/00 273/400 |
| 6,849,009 | B1 | 2/2005 | Forlini | |
| 7,244,199 | B1 * | 7/2007 | Romano | A63B 71/022 273/127 R |
| 7,963,865 | B2 | 6/2011 | Rigoli | |
| 10,195,508 | B2 | 2/2019 | Rigoli | |
| 2008/0009374 | A1 * | 1/2008 | Valdez | A63C 19/08 473/490 |
| 2010/0222162 | A1 * | 9/2010 | Stephenson | A63B 69/002 473/446 |
| 2013/0303312 | A1 * | 11/2013 | DeBolt | A63B 69/0097 473/446 |
| 2016/0354662 | A1 * | 12/2016 | Conforti | A63B 71/022 |
| 2017/0173431 | A1 * | 6/2017 | Rigoli | A63B 63/004 |
| 2018/0078840 | A1 * | 3/2018 | Gravel | A63B 71/0054 |
| 2019/0083870 | A1 * | 3/2019 | Kapsalis | A63B 69/002 |

* cited by examiner

*Primary Examiner* — Eugene L Kim
*Assistant Examiner* — Christopher Glenn
(74) *Attorney, Agent, or Firm* — Thomas G Ference

(57) ABSTRACT

A backstop for placement around a goal to stop sport projectiles from traveling beyond the outer edge of the goal, the backstop includes a material implement having a goal acceptance aperture located substantially central to the bottom edge and extending towards the top edge. The backstop includes an attachment mechanism that secures the material implement to the goal. The backstop further includes at least one bracket that is operable to attach to the goal frame. A support structure extends from the at least one bracket and is operable to support the material implement to extend beyond the outer edge of the goal.

36 Claims, 24 Drawing Sheets

SPORTS GOAL BACKSTOP SYSTEM

CROSS-REFERENCE TO RELATED APPLICATIONS

This application claims the benefit of priority of U.S. Provisional Patent Application No. 63/071,458 filed Aug. 28, 2020, which is herein incorporated by reference.

FIELD

The invention generally relate to sports equipment. More specifically, the invention relates to a backstop for placement around a goal to stop sport projectiles from traveling beyond the outer edge of the goal.

BACKGROUND

The retrieval of sport projectiles that miss a goal and that travel beyond the outer edge of the goal can have several negative consequences. First, collection of these "missed" projectiles can be very time consuming resulting in slowed down play and use up practice or game time. Second, during a typical practice, many extra practice balls may be needed to prevent repeatedly stopping to retrieve a lesser numbers of balls to continue practicing. Third, missed projectiles can be lost in high grass, brush and trees behind the goal requiring the purchase of more projectiles. Fourth, missed projectiles can hit objects located behind the goal resulting in property damage.

By way of educational background, an aspect of the related technology generally useful to be aware of is that there are some currently available devices meant to stop projectiles from traveling beyond the outer edge of the goal. In general these backstops do not fit across multiple sport goals/types/sizes. For example, these devices are often configured to be specific to a particular sport such as, but not limited to, soccer, lacrosse and hockey. These backstops are not readily transferable to other sports goals. Then within a specified sport, there may be devices that are designed to only be attached to a specific goal and are not transferable or attachable to other goals for the same sport. Even further many backstop devices require tools to install and if you don't have the tools readily available, you cannot set up the backstop.

In view of the foregoing, it is clear that these traditional techniques are not perfect and leave room for more optimal approaches. The present invention aims to solve the above noted deficiencies of the prior art by being attachable to goals from a variety of sports and also being easily set up without any tools.

SUMMARY

In one implementation, the present disclosure is directed to a backstop for placement around a goal to stop sport projectiles from traveling beyond an outer edge of the goal, the goal having a frame supporting a goal net. The backstop comprises a material implement having a top edge, side edges and a bottom edge. The material implement has a goal acceptance aperture located substantially central to the bottom edge and extends towards the top edge. The backstop also comprises at least one bracket that is operable to attach to the goal frame. A support structure extends from the at least one bracket and is operable to support the material implement to extend beyond the outer edge of the goal. The backstop further comprises an attachment mechanism that secures the material implement to the goal.

In another implementation, the present disclosure is directed to a backstop for placement around a goal to stop sport projectiles from traveling beyond an outer edge of the goal, the goal having a frame supporting a goal net, the goal net having a goal net mesh. The backstop comprises a material implement having a top edge, side edges and a bottom edge. The material implement has a goal acceptance aperture located substantially central to the bottom edge and extends towards the top edge. The backstop also comprises a pair of brackets operable to attach to the goal frame. A support structure extends from each bracket operable to support the material implement to extend beyond the outer edge of the goal. The backstop further comprises lacing cord for threading through any number of the backstop mesh openings and the goal net mesh to secure the backstop net to the goal net.

In yet another implementation the present disclosure is directed to a backstop for placement around a goal to stop sport projectiles from traveling beyond an outer edge of the goal, the goal having a frame supporting a goal net. The backstop comprises a material implement having a top edge, side edges and a bottom edge. The material implement has a goal acceptance aperture located substantially central to the bottom edge and extends towards the top edge. The backstop also comprises at least one bracket operable to attach to the goal frame. A support structure extends from the each bracket and is operable to support the material implement to extend beyond the outer edge of the goal. The backstop further comprises an attachment mechanism operable to secure the material implement to the goal. The backstop further includes an adjustable weight system attachable at different heights above the bottom edge on either side of the goal acceptance aperture to allow the material implement to fit different size goals.

In still yet another implementation, the present disclosure is directed to a bracket for attachment to a frame. The bracket comprises a body portion having a top, a bottom and a frame acceptance face. A channel is located along the frame acceptance face from the top to bottom for accepting the frame. The bracket also comprises at least one stationary hook adjacent a first side of the channel and an adjustable hook adjacent the opposite side of the channel. The bracket further comprises a strap running between the stationary hook and the adjustable hook to adjustably hold the frame securely within the channel.

BRIEF DESCRIPTION OF DRAWINGS

For the purposes of illustrating the invention, the drawings show aspects of one or more embodiments of the invention. However, it should be understood that the present invention is not limited to the precise arrangements and instrumentalities shown in the drawings, wherein.

DETAILED DESCRIPTION

Figure 1:
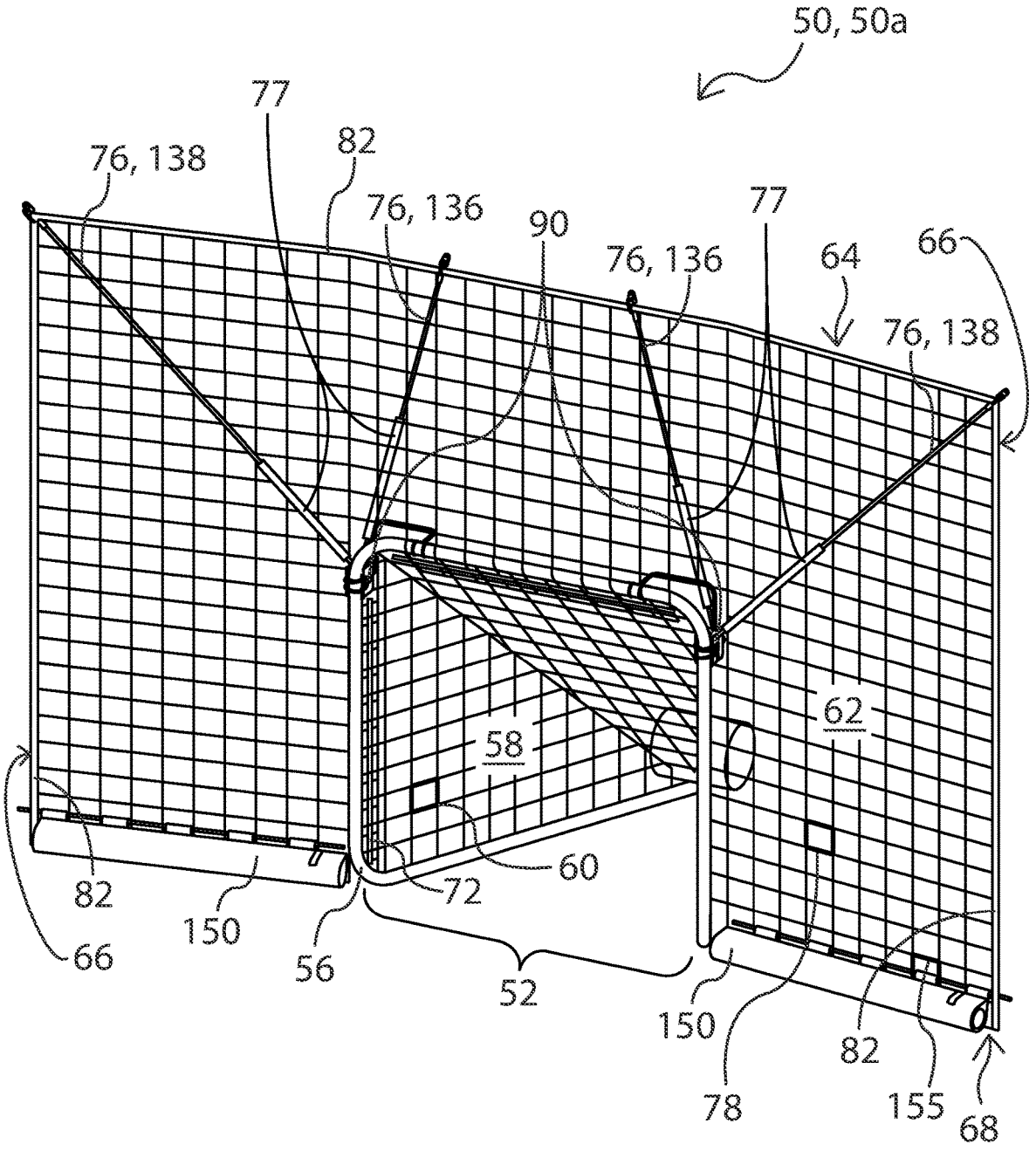
FIG. 1 is a front perspective view of one embodiment of a backstop in accordance with the present invention.
Figure 2:
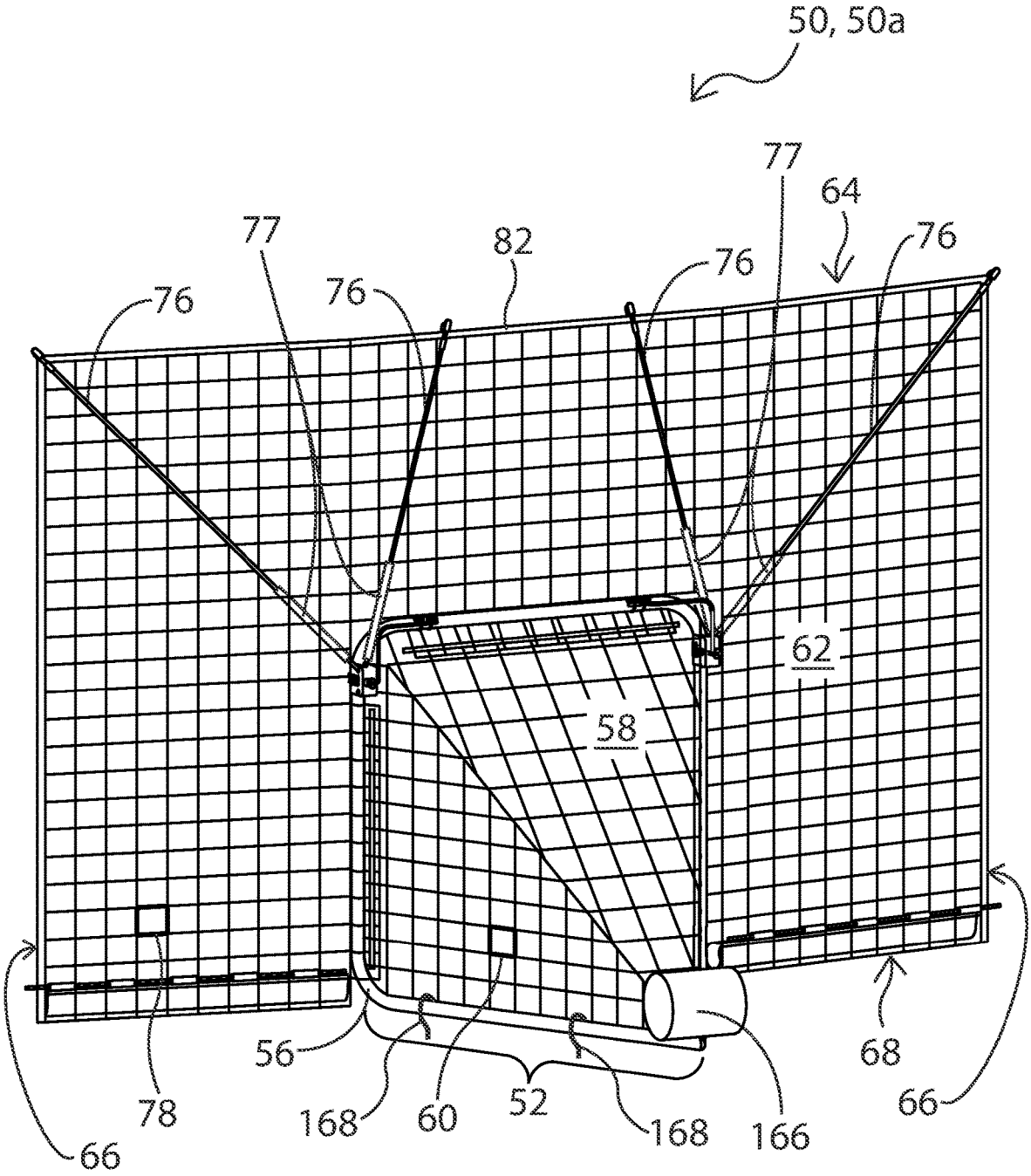
FIG. 2 is a back perspective view of the backstop of FIG. 1.
Figure 3:
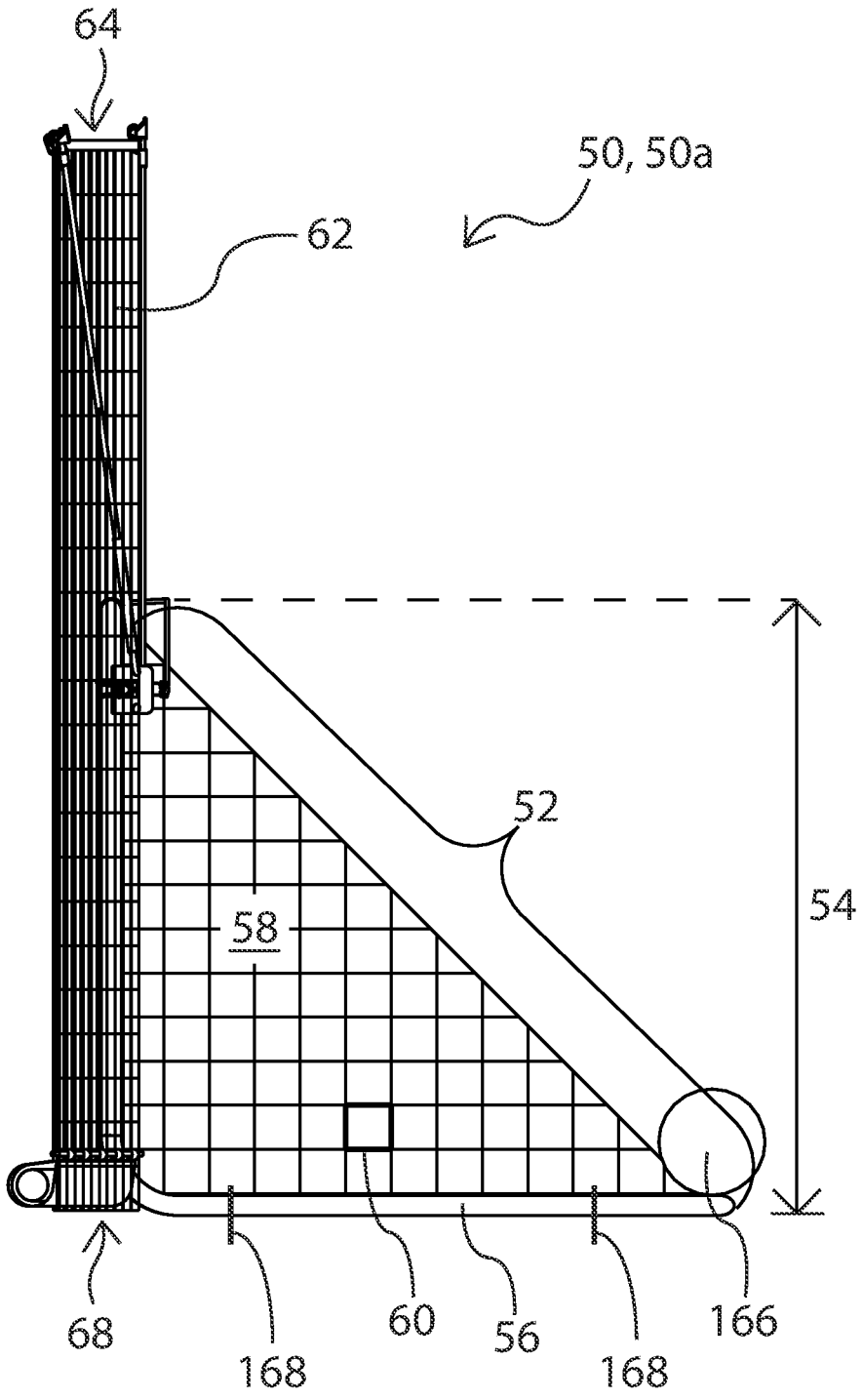
FIG. 3 is a right side view of the backstop of FIG. 1.
Figure 4A:
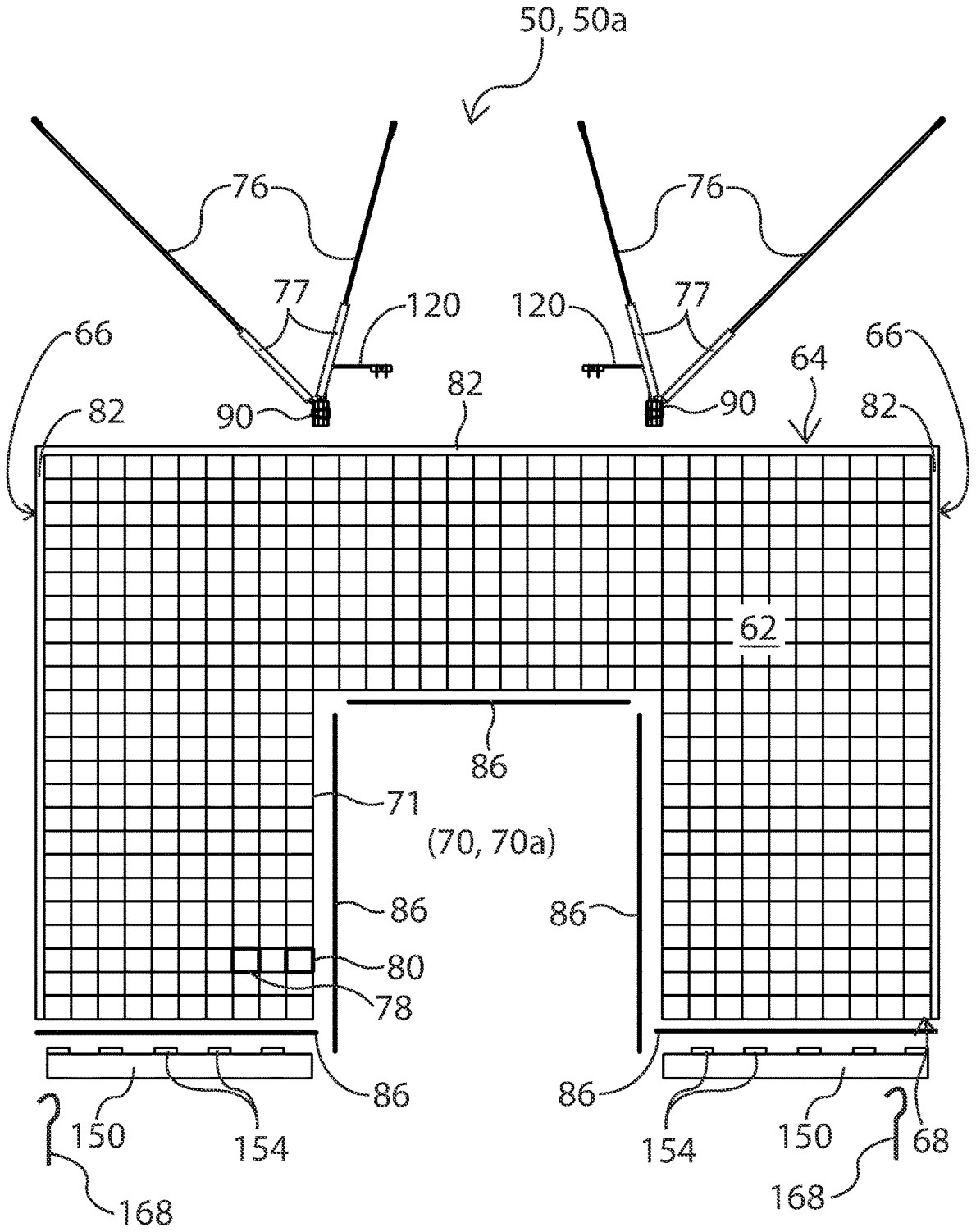
FIG. 4*a* is a plan view of the components making up the backstop of FIG. 1.
Figure 4B:
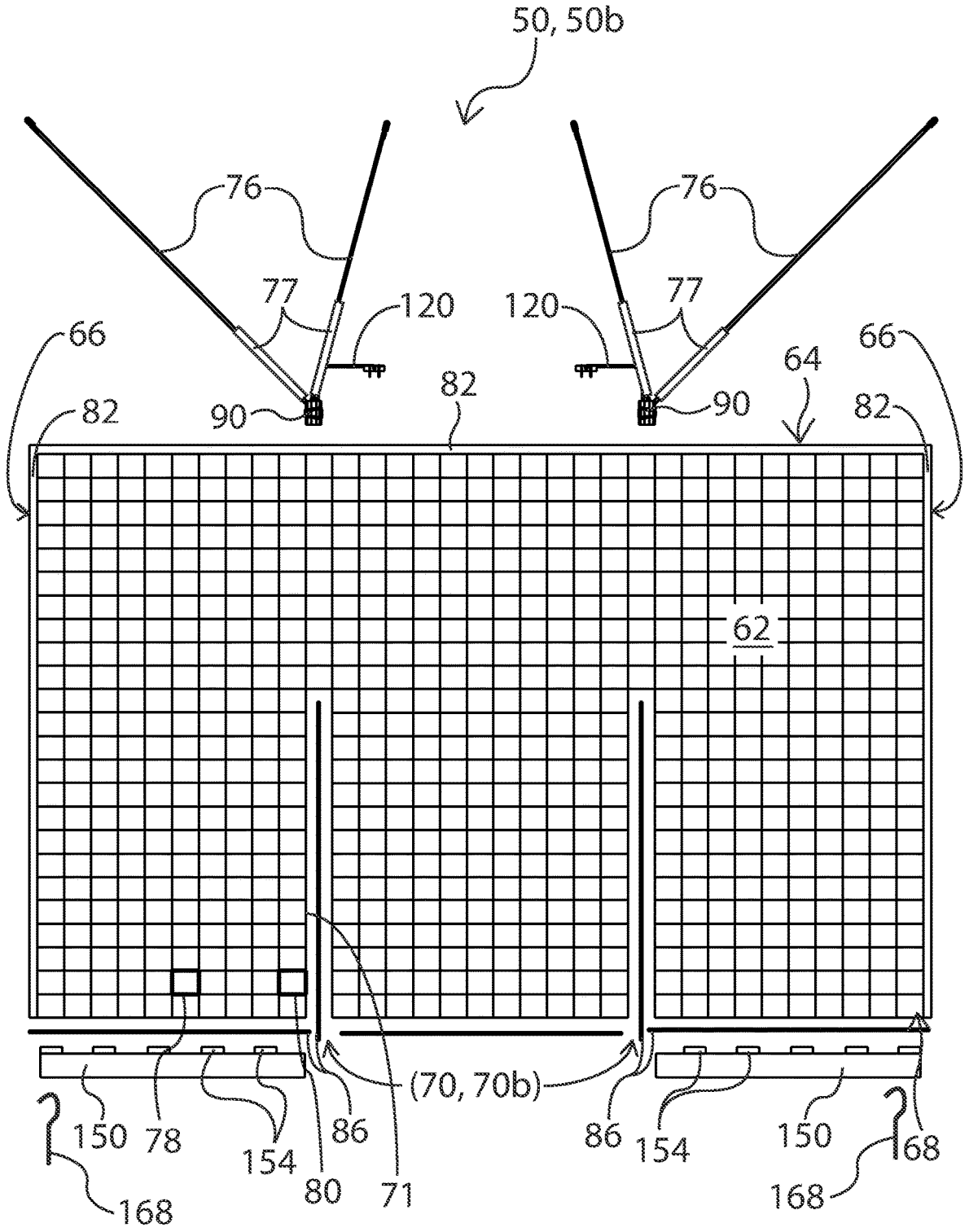
FIG. 4*b* is a plan view of an alternative embodiment of the components making of the backstop of FIG. 1.
Figure 5A:
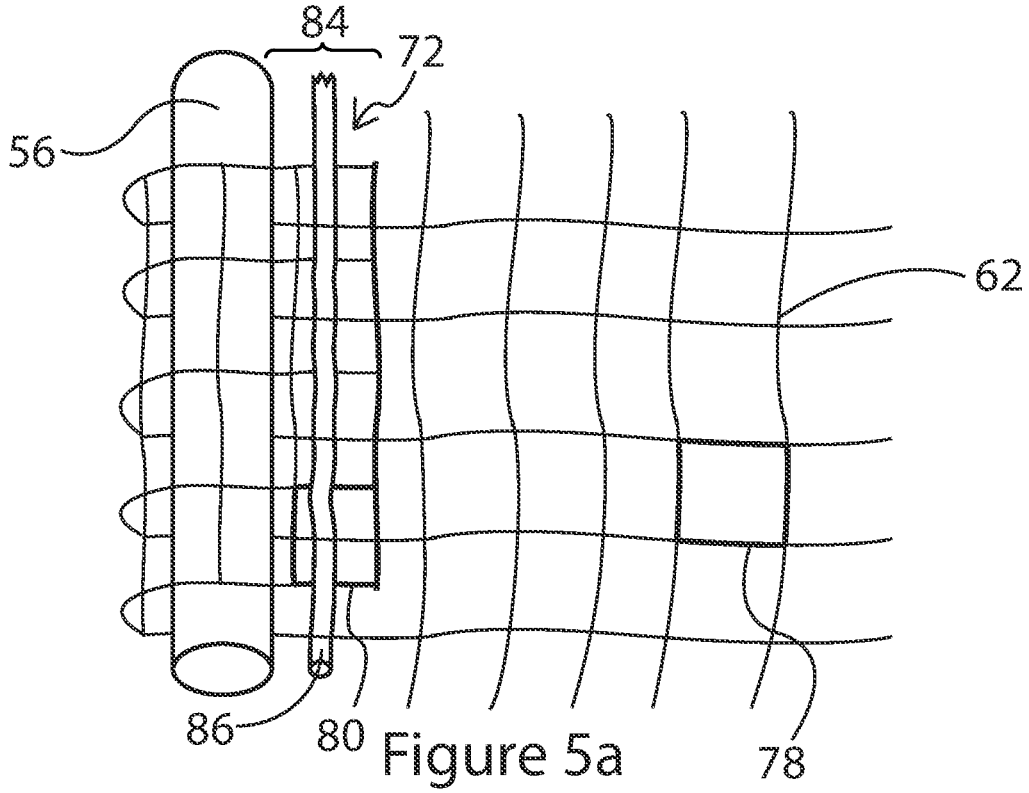
FIG. 5*a* is a perspective view of one embodiment for connecting the material implement of the backstop to the goal frame for the backstop of FIG. 1.
Figure 5B:
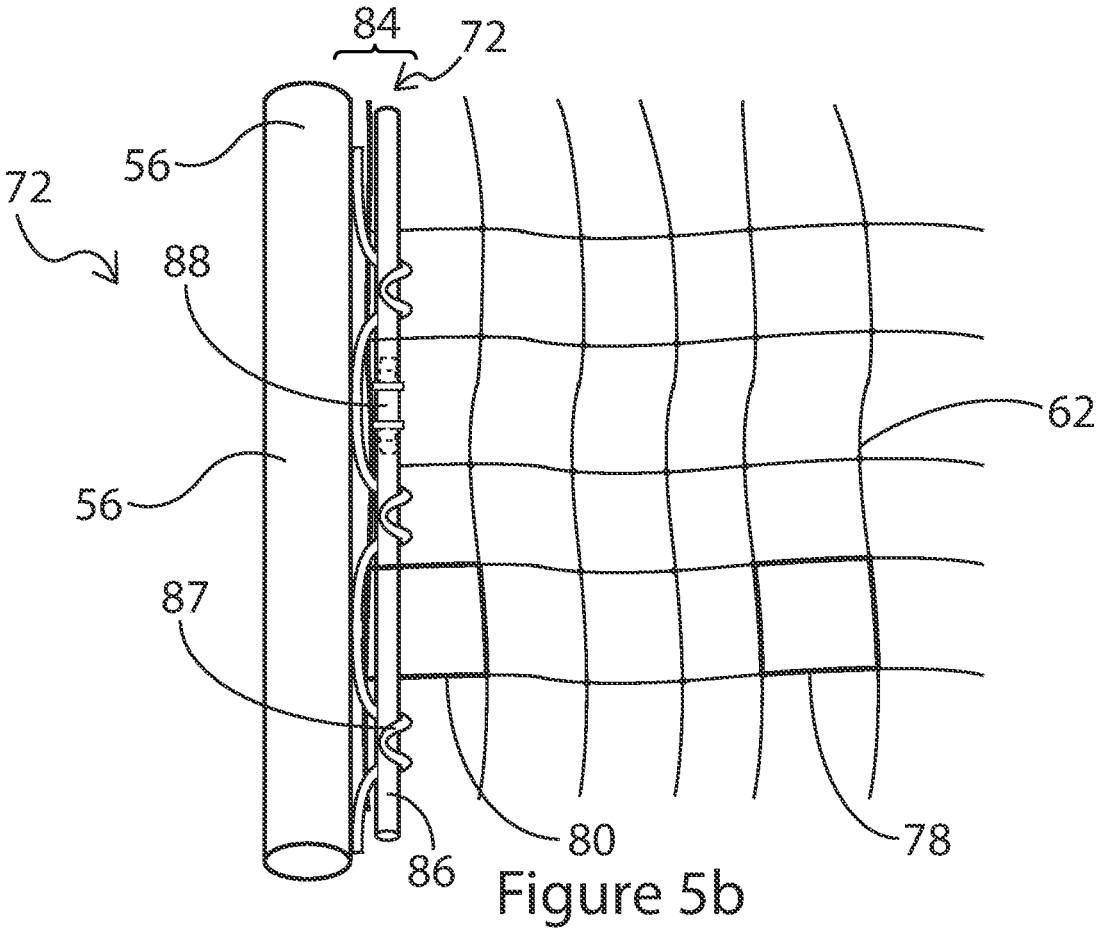
FIG. 5*b* is a perspective view of another embodiment for connecting the material implement of the backstop to the goal frame for the backstop of FIG. 1.
Figure 5C:
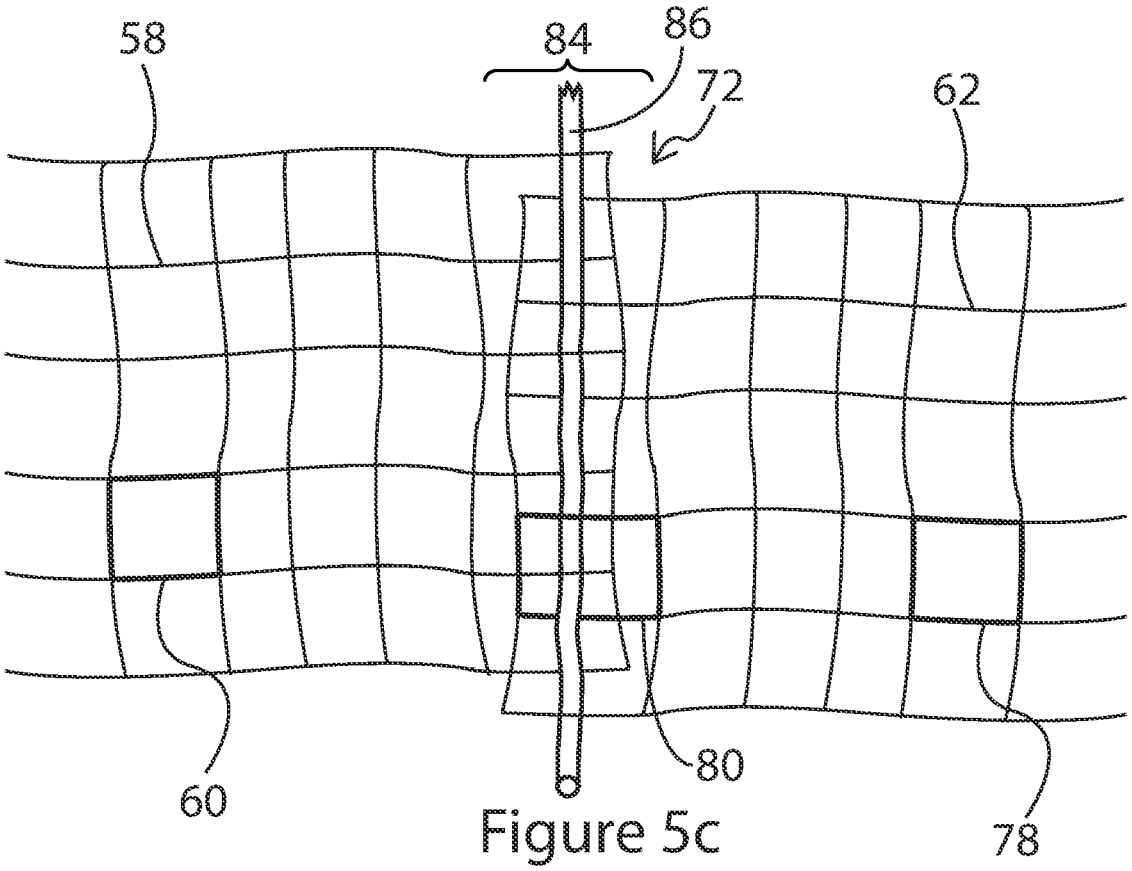
FIG. 5*c* is a perspective view of another embodiment for connecting the material implement of the backstop to the goal net for the backstop of FIG. 1.
Figure 5D:
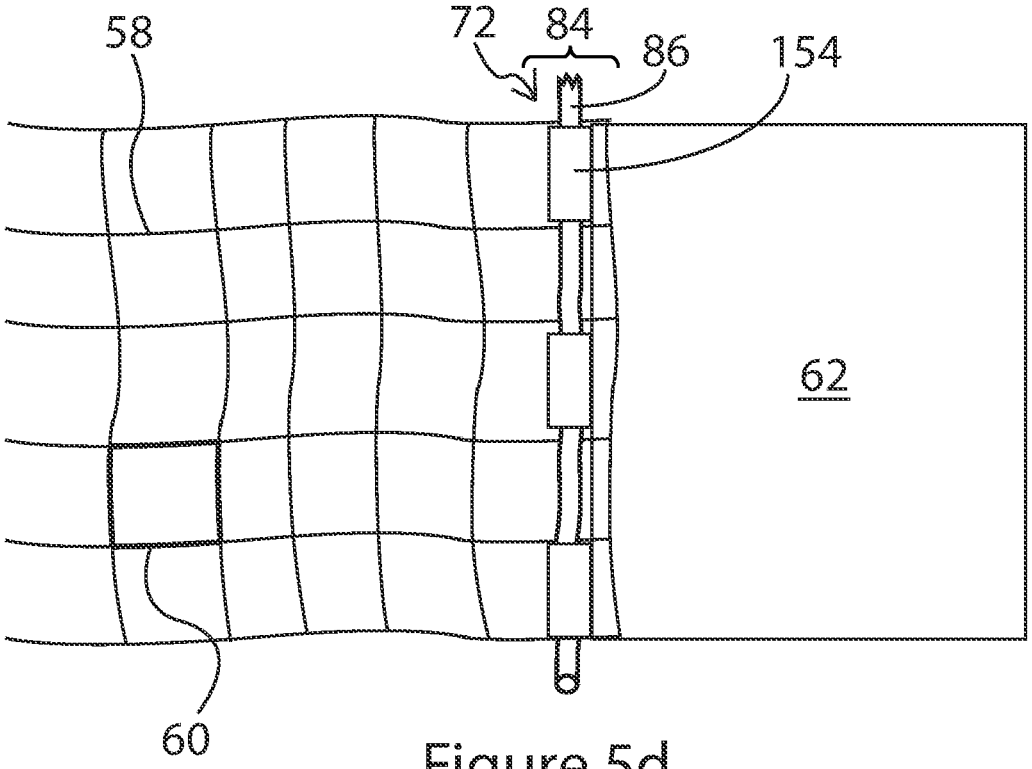
FIG. 5*d* is a perspective view of another embodiment of connecting the material implement of the backstop to the goal net for the backstop of FIG. 1.
Figure 6:
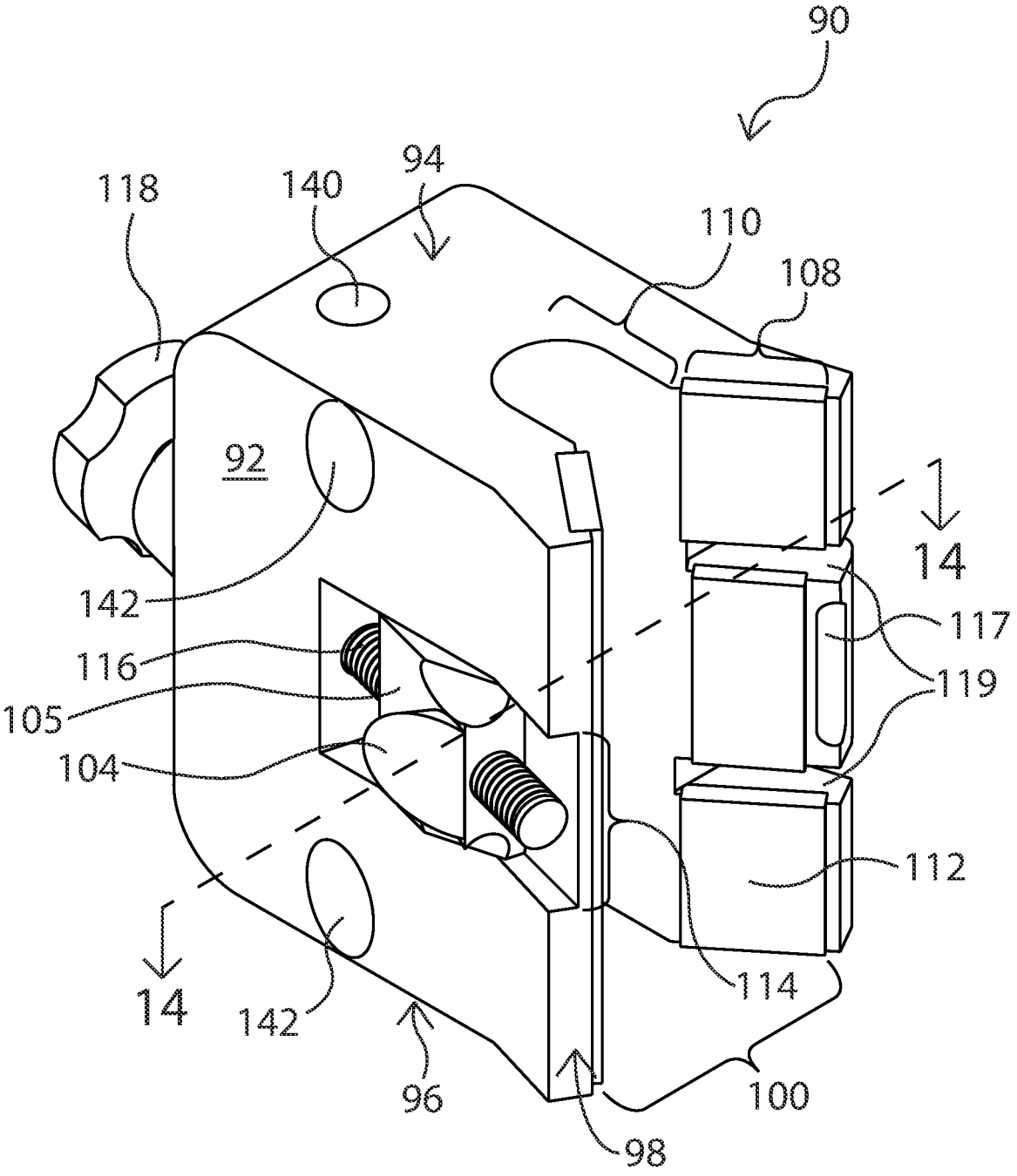
FIG. 6 is a front perspective view of the bracket of FIG. 1.
Figure 7:
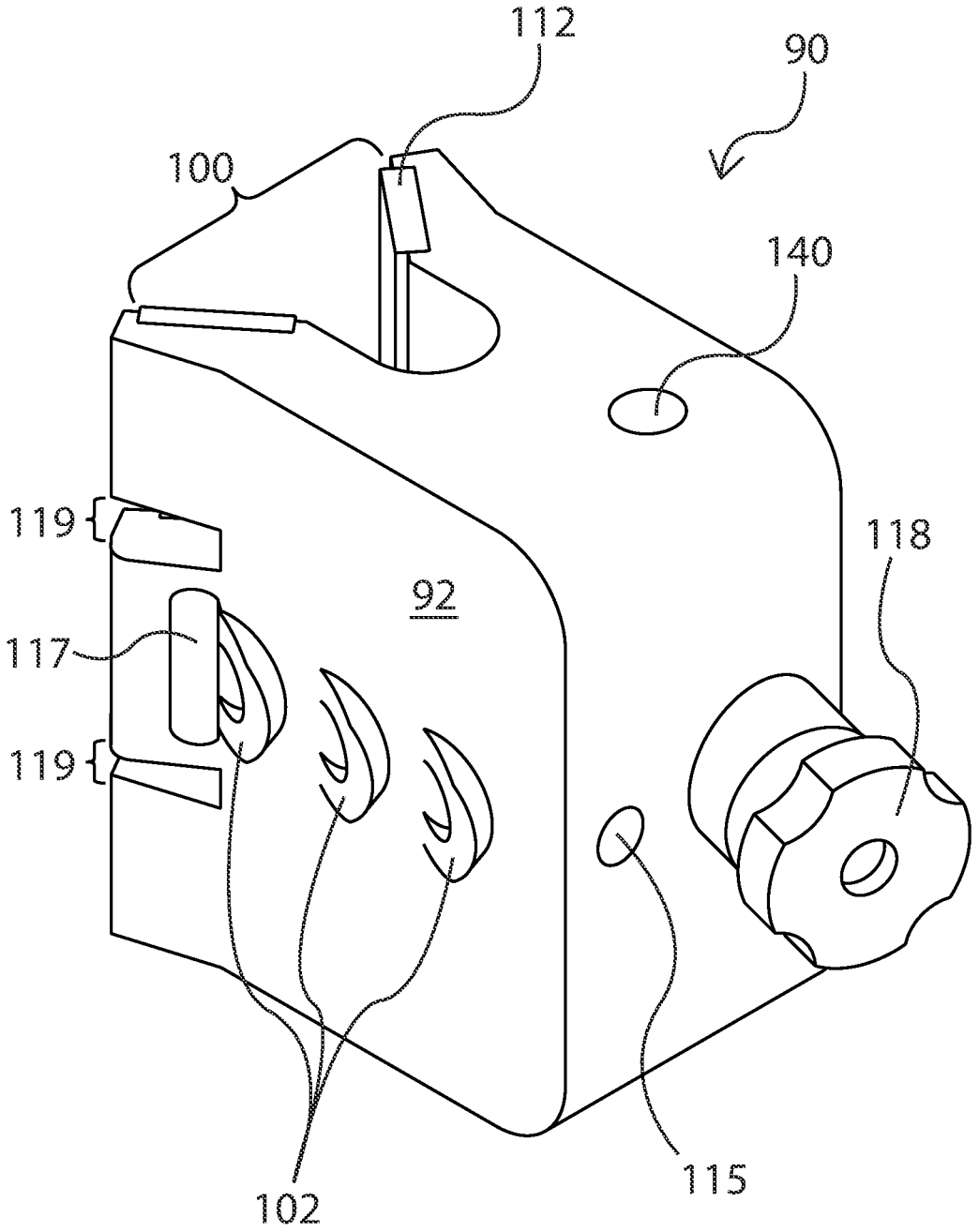
FIG. 7 is a back perspective view of the bracket of FIG. 6.
Figure 8:
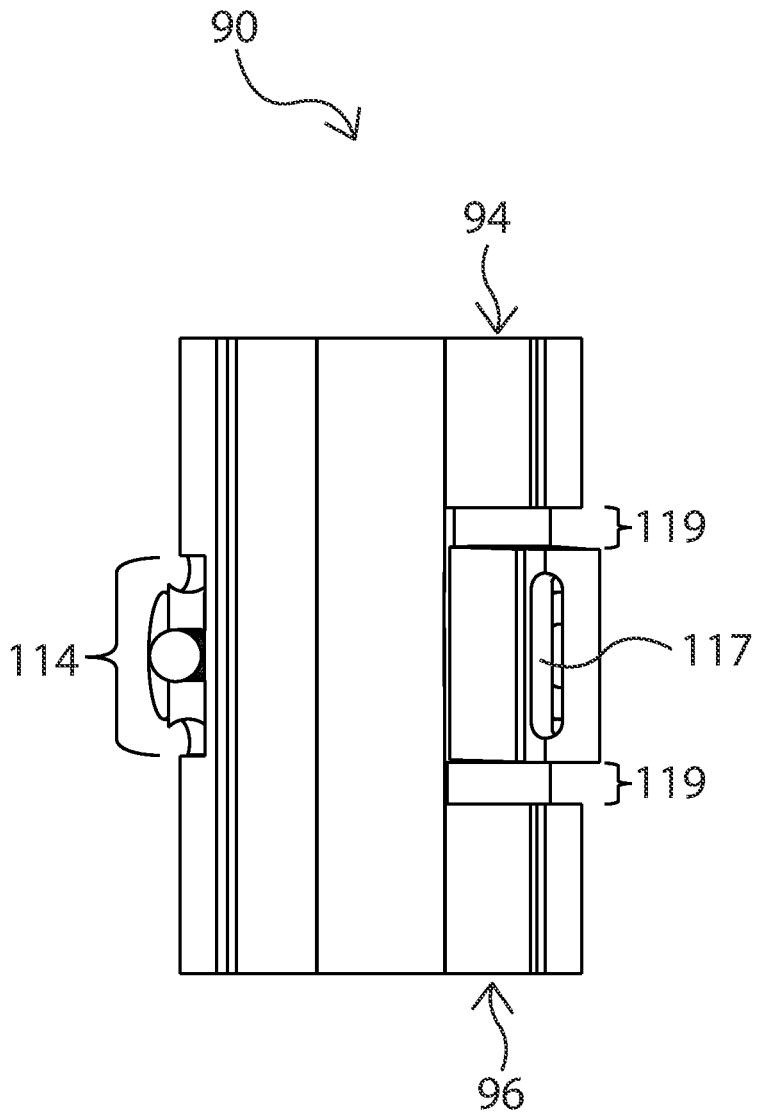
FIG. 8 is a front view of the bracket of FIG. 6.
Figure 9:
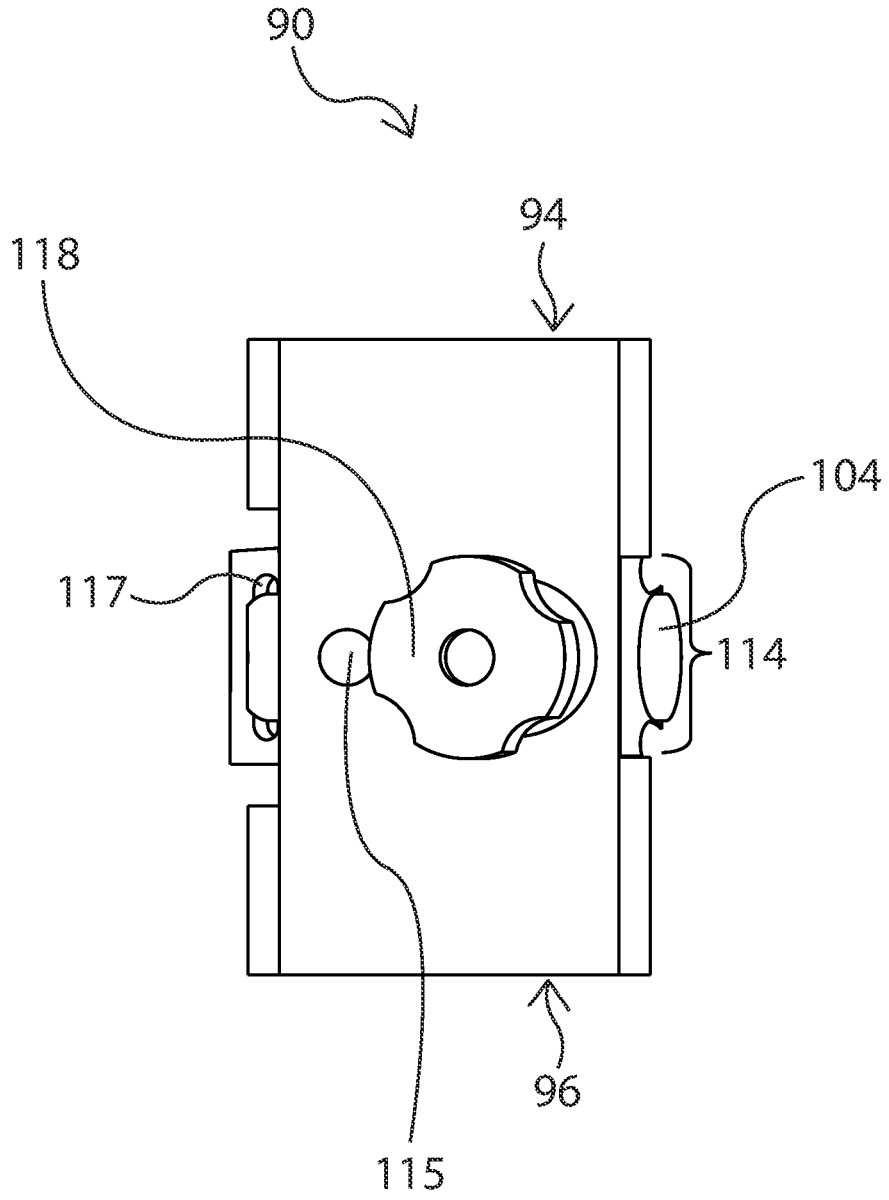
FIG. 9 is a back view of the bracket of FIG. 6.
Figure 10:
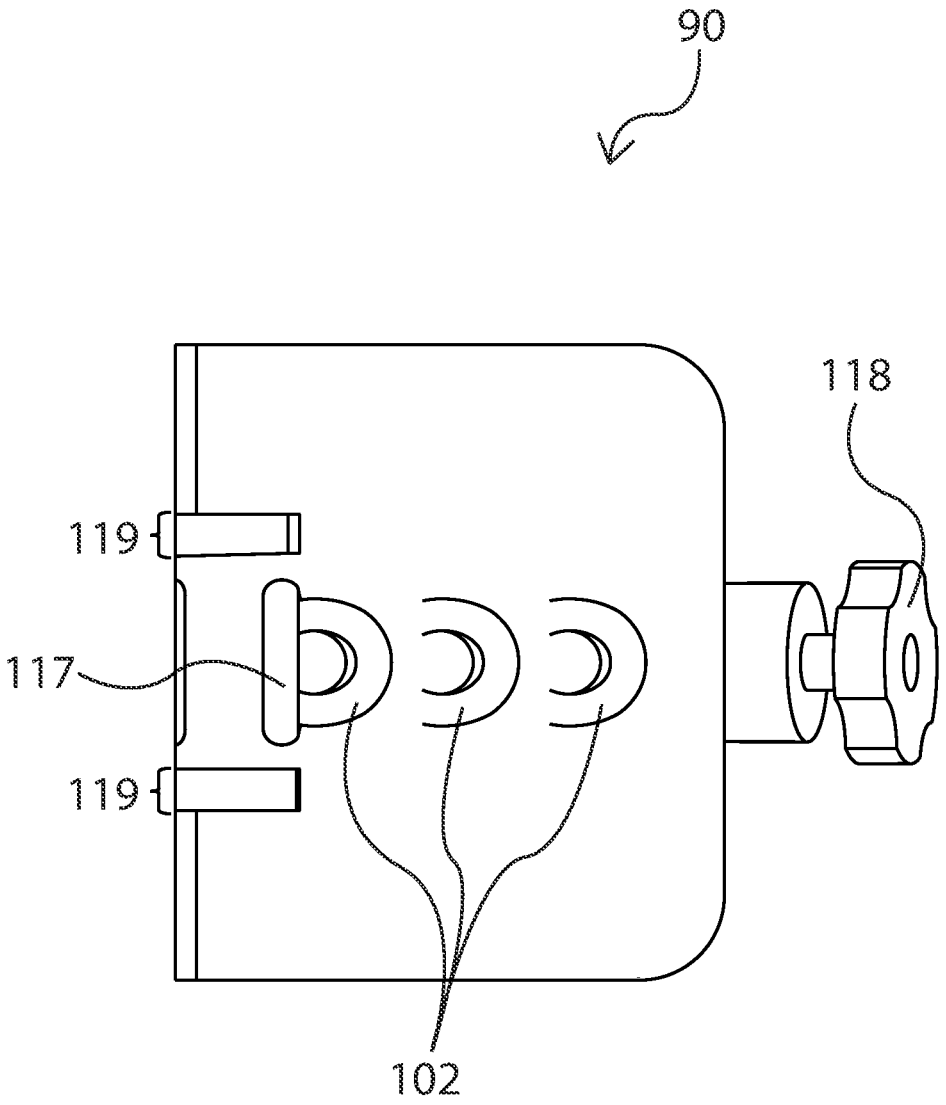
FIG. 10 is a right side view of the bracket of FIG. 6.
Figure 11:
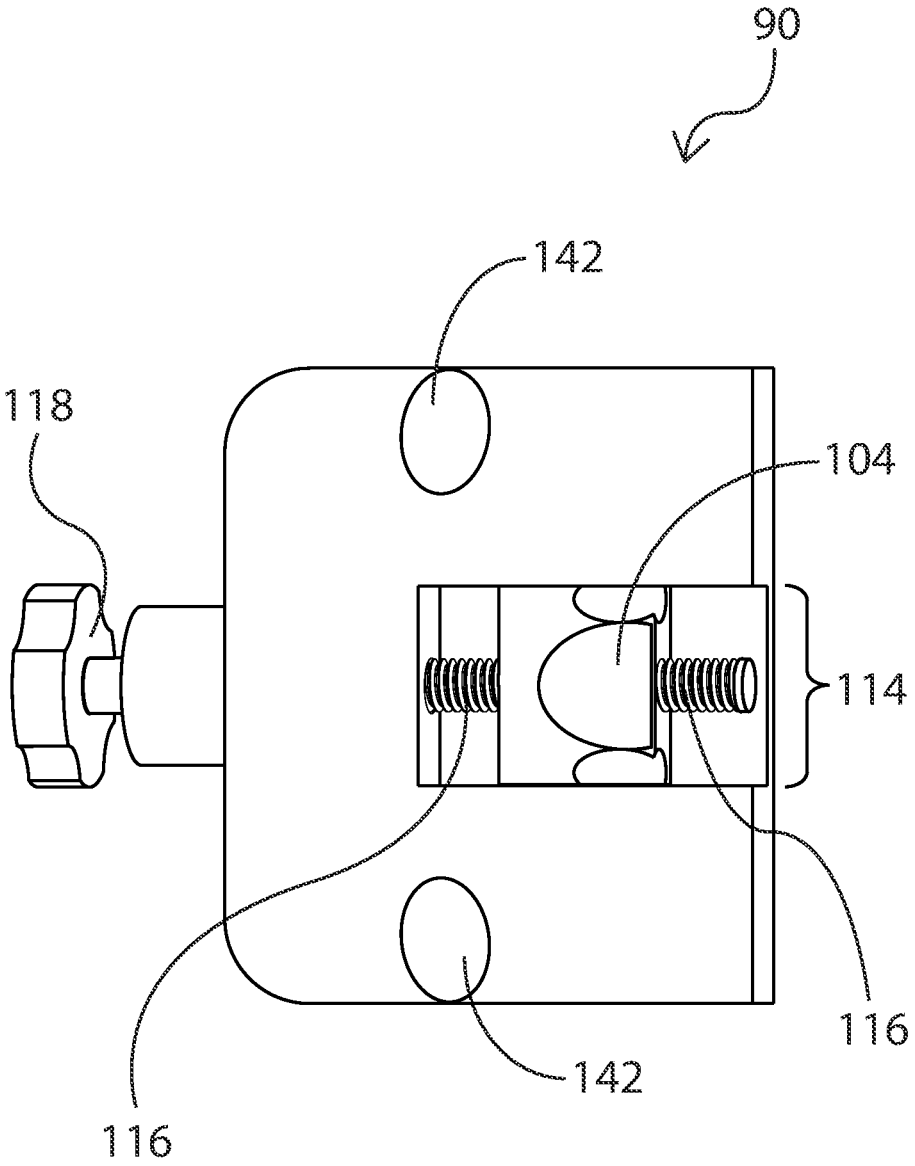
FIG. 11 is a left side view of the bracket of FIG. 6.
Figure 12:
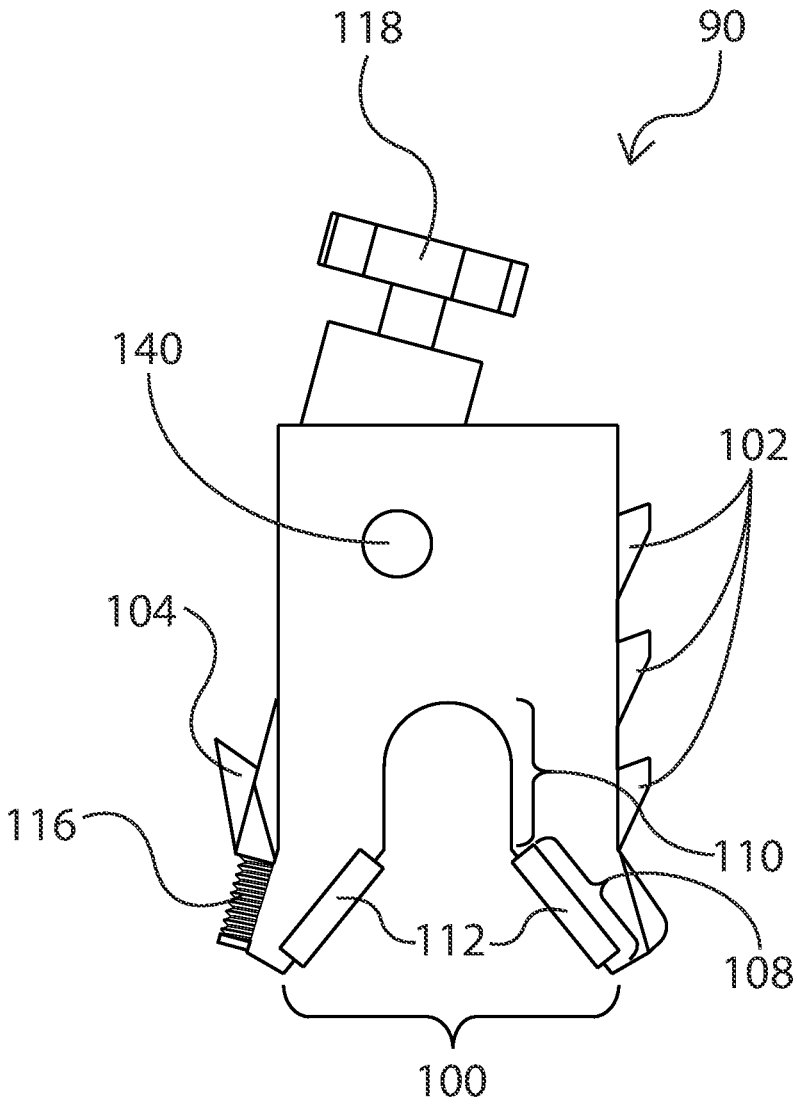
FIG. 12 is a top view of the bracket of FIG. 6.
Figure 13:
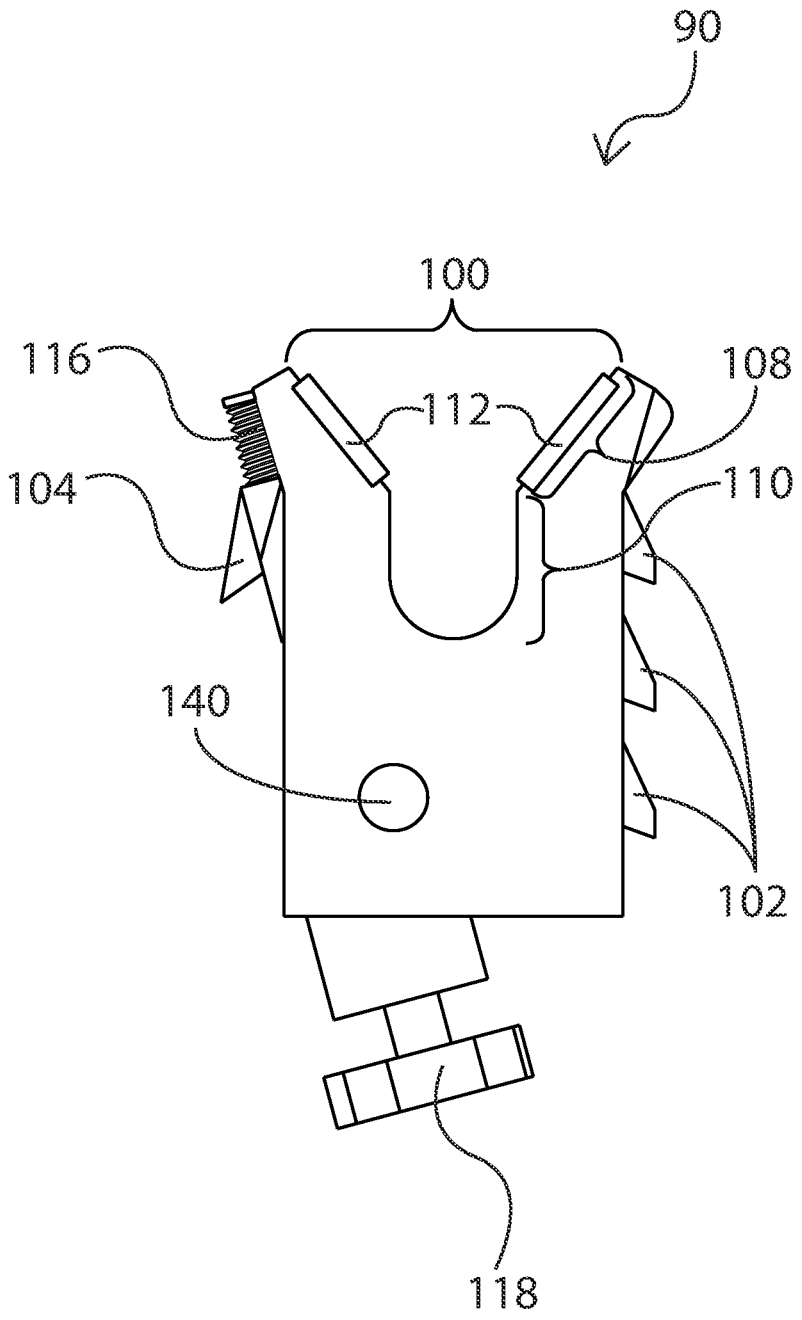
FIG. 13 is a bottom view of the bracket of FIG. 6.
Figure 14:
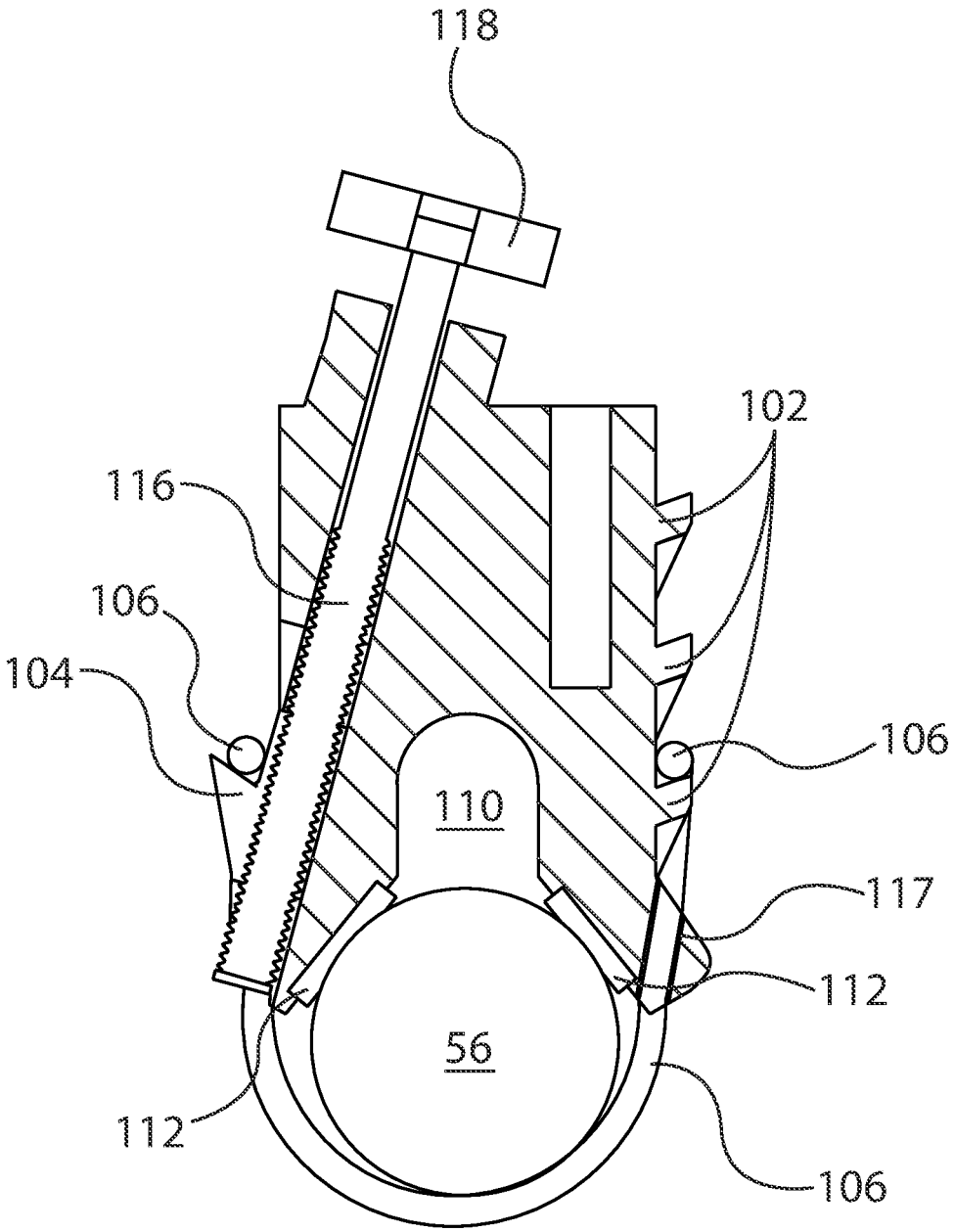
FIG. 14 is a sectional view along line 14-14 of the bracket of FIG. 6 that has been integrated with a goal frame.
Figure 15A:
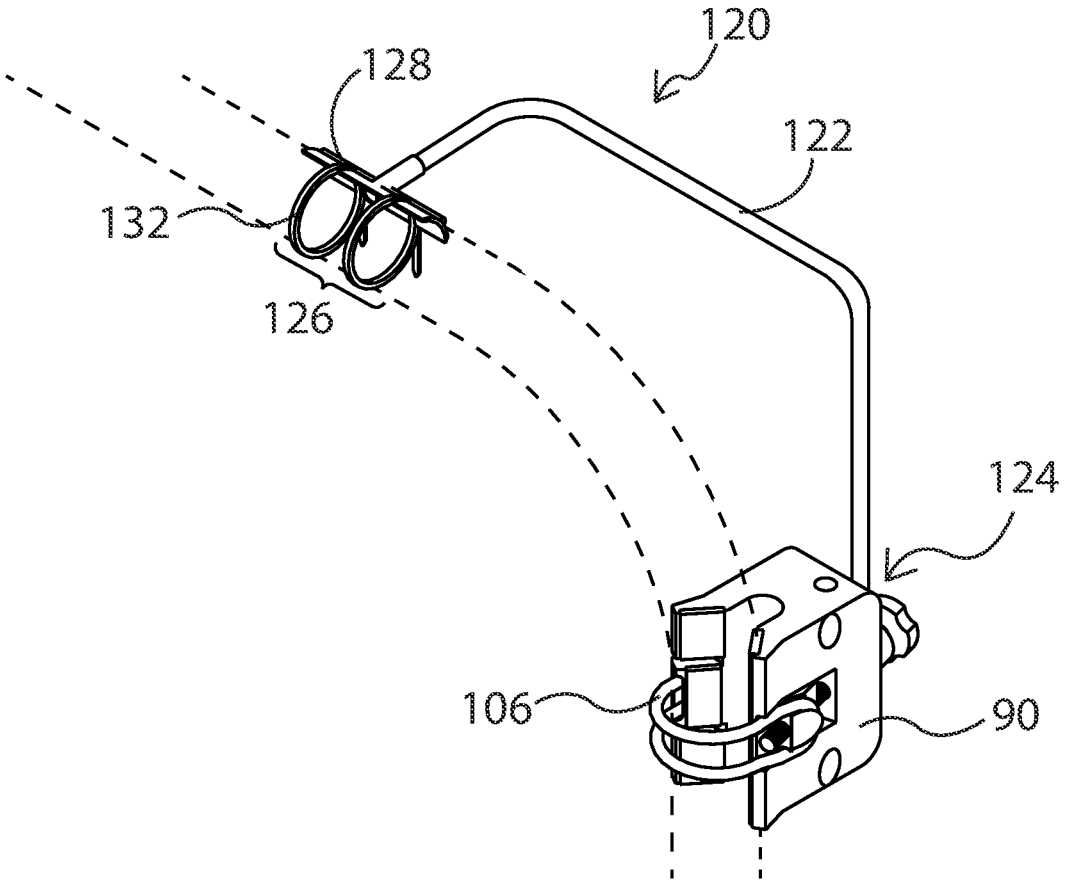
FIG. 15*a* is a perspective view of a bracket with strut as attached to the right side of the goal frame for the backstop of FIG. 1.
Figure 15B:
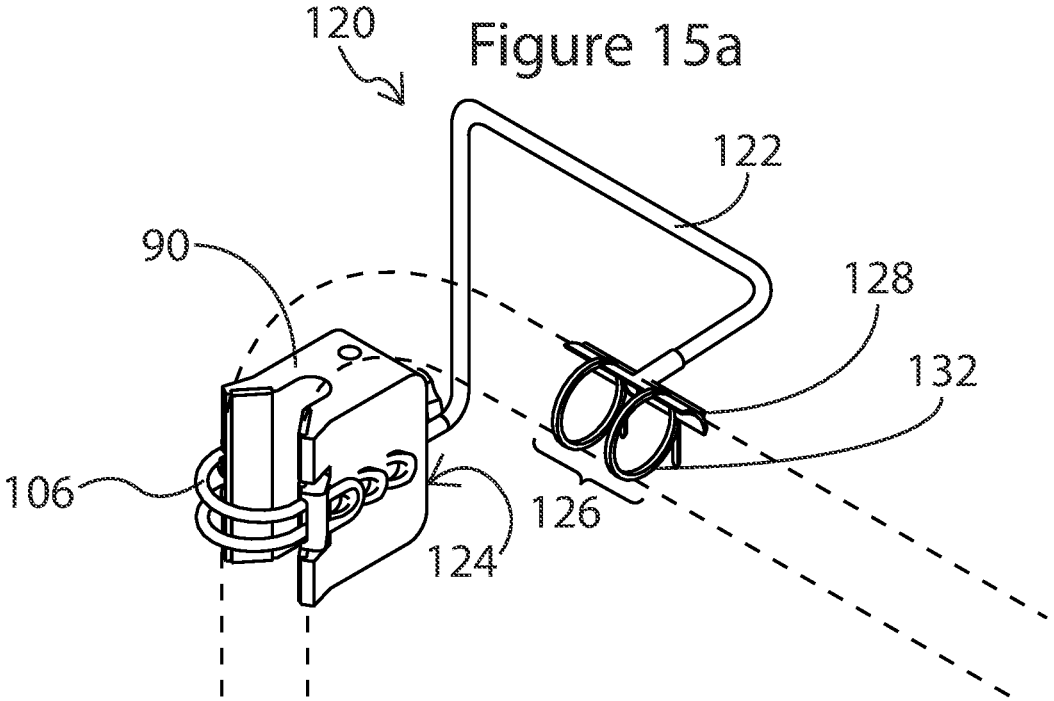
FIG. 15*b* is a perspective view of a bracket with strut as attached to the left side of the goal frame for the backstop of FIG. 1.
Figure 16A:
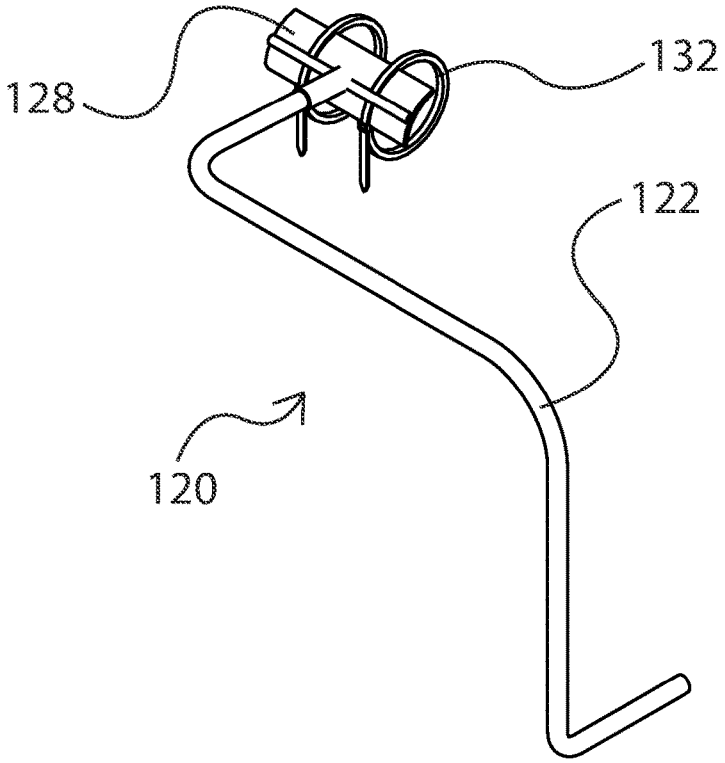
FIG. 16*a* is a top perspective view of a strut that may be used with the backstop of FIG. 1.
Figure 16B:
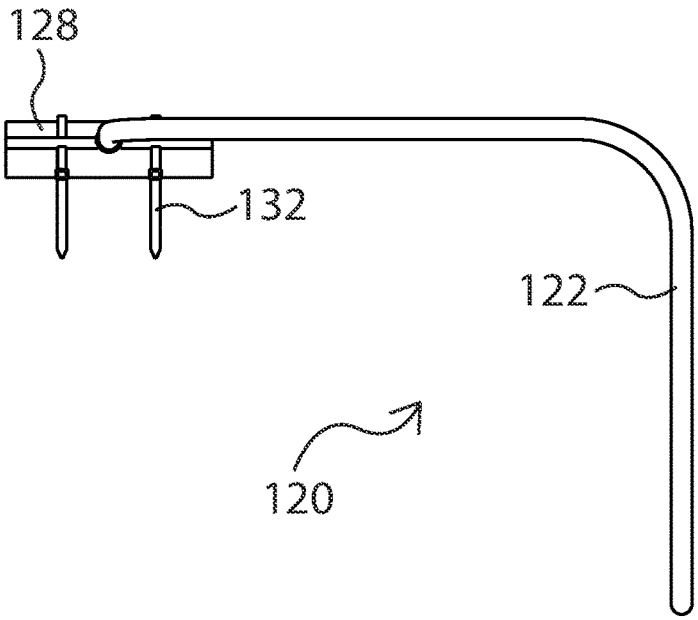
FIG. 16*b* is a front view of the strut of FIG. 16*a;*
Figure 16C:
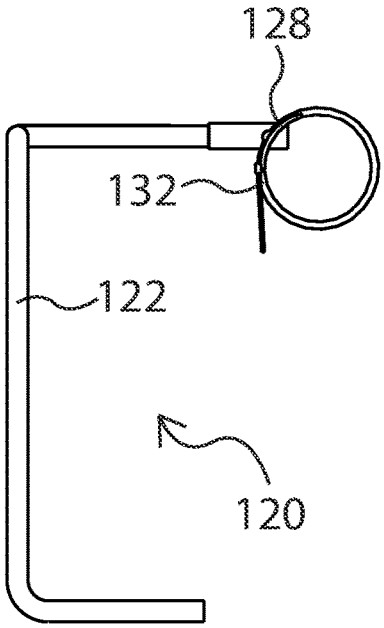
FIG. 16*c* is a side view of the strut of FIG. 16*a;*
Figure 17:
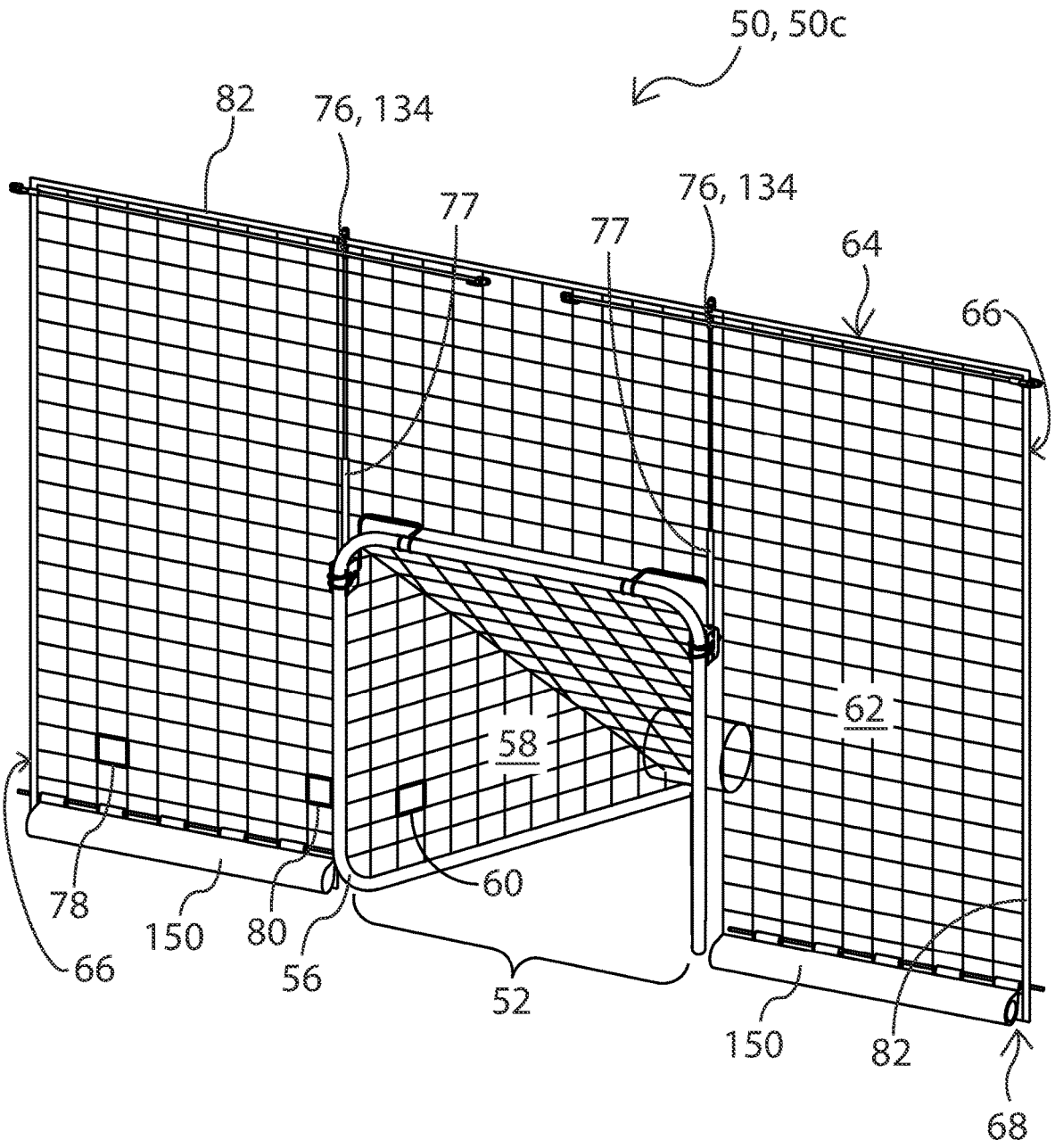
FIG. 17 is a front perspective view one embodiment of a backstop integrating the brackets of FIG. 6 with an alternative embodiment of support structures.
Figure 18:
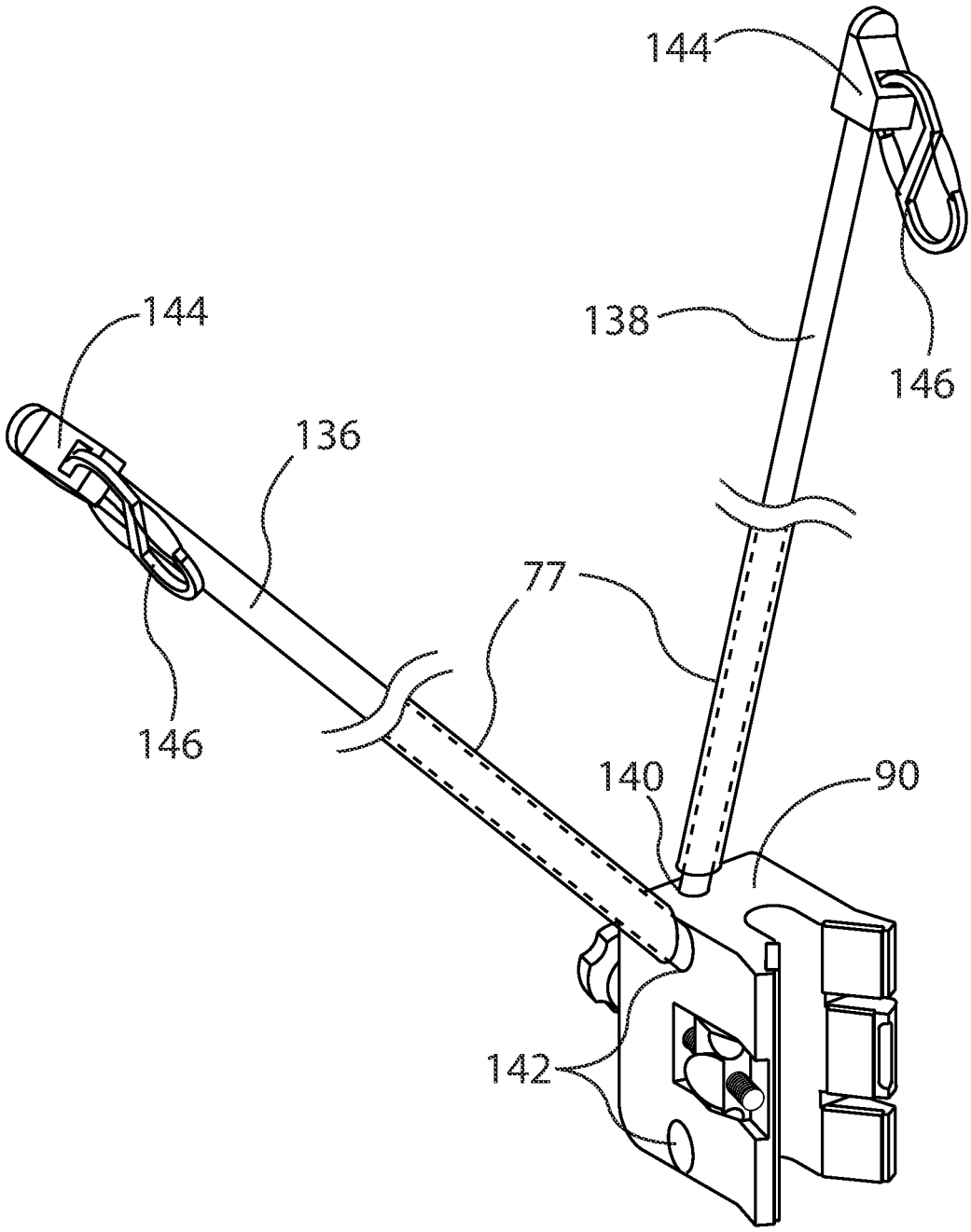
FIG. 18 is a front perspective view of the bracket of FIG. 6 integrated with one embodiment of support structures as used in FIG. 1.
Figure 19A:
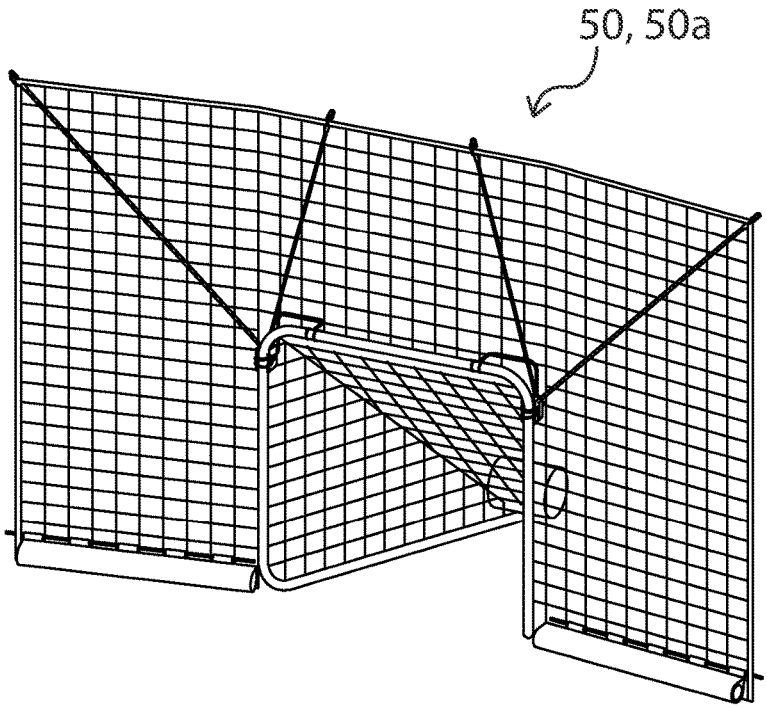
FIG. 19*a* is a front perspective view of a lacrosse goal integrated with the backstop of FIG. 1.
Figure 19B:
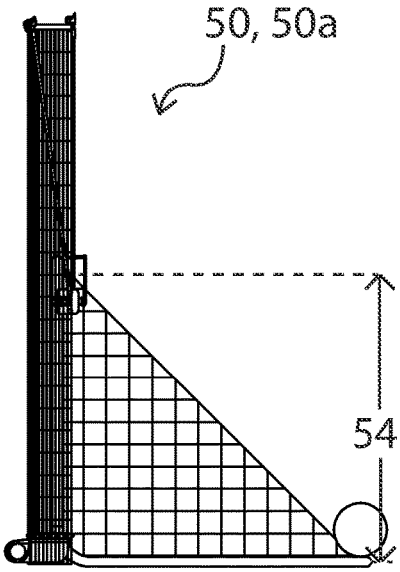
FIG. 19*b* is side view of FIG. 19*a;*
Figure 19C:
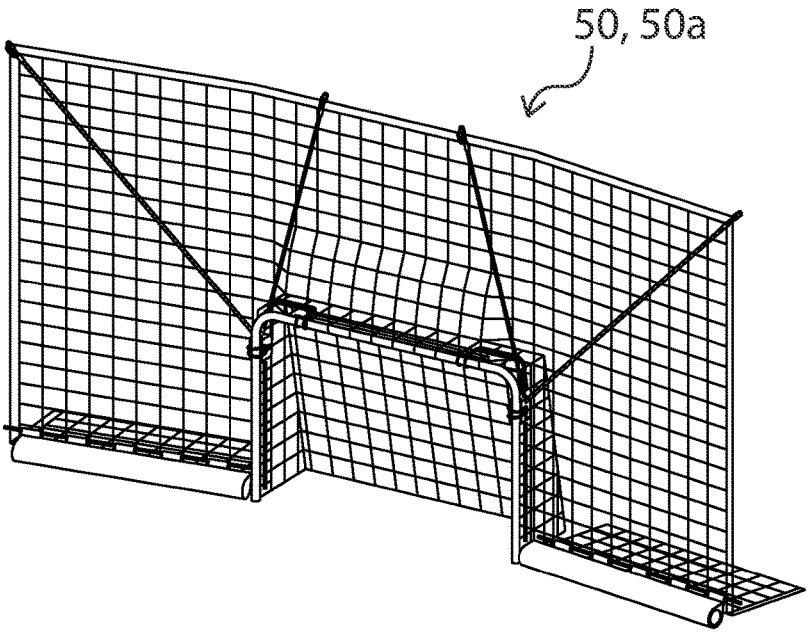
FIG. 19*c* is a front perspective view of a hockey goal integrated with the backstop of FIG. 1.
Figure 19D:
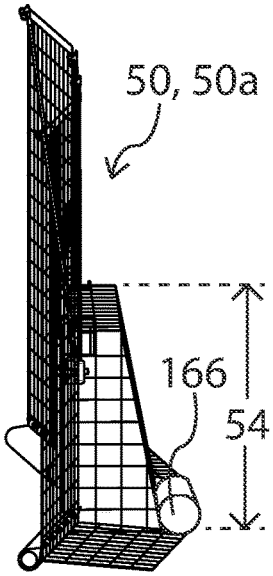
FIG. 19*d* is a side view of FIG. 19*c;*
Figure 20A:
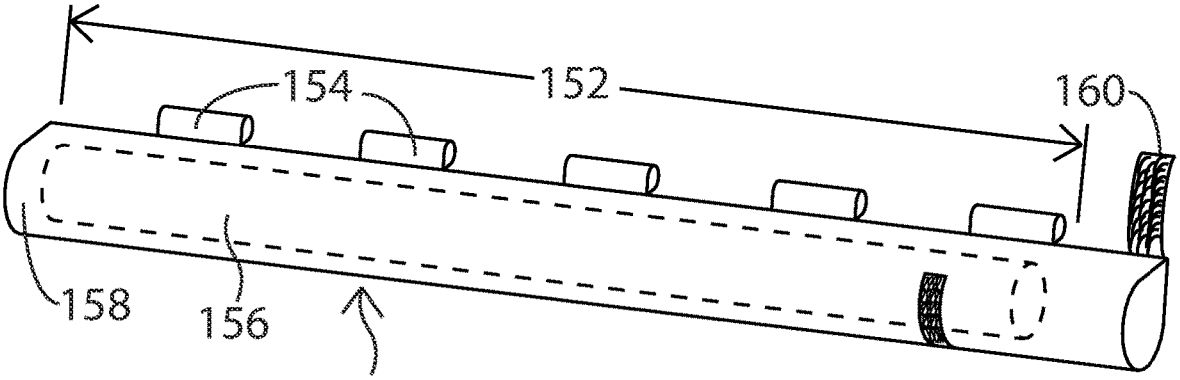
FIG. 20*a* is a front perspective view of a side weight of FIG. 1 showing a first step in securing the inner weight with the outer sleeve.
Figure 20B:
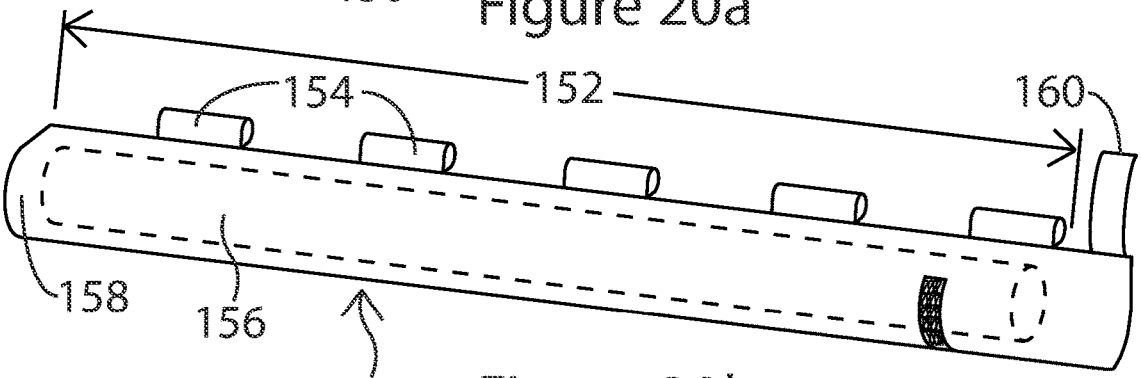
FIG. 20*b* is a front perspective view of the side weight of FIG. 1 showing a second step in securing the inner weight with the outer sleeve.
Figure 20C:
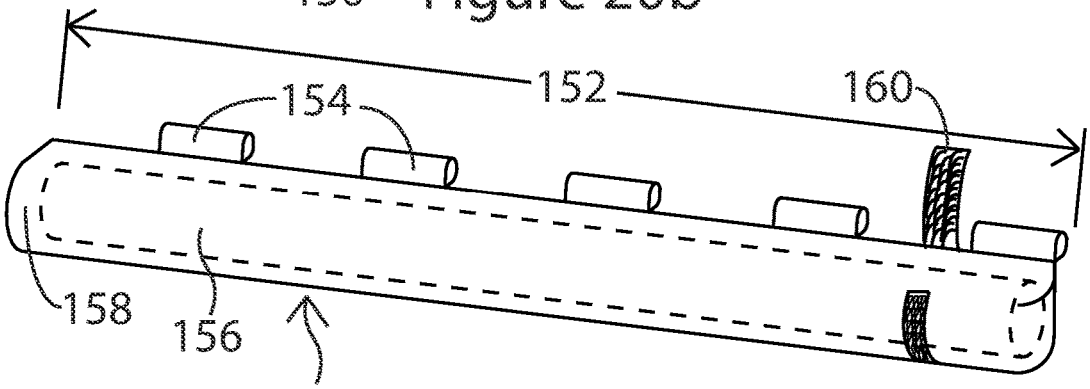
FIG. 20*c* is a front perspective view of the side weight of FIG. 1 showing a third step in securing the inner weight with the outer sleeve.
Figure 20D:
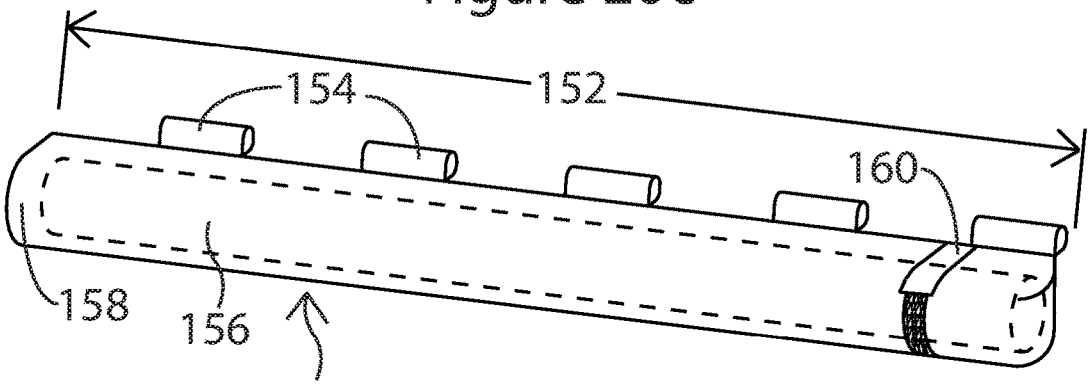
FIG. 20*d* is a front perspective view of the side weight of FIG. 1 showing a fourth step in securing the inner weight with the outer sleeve.
Figure 21A:
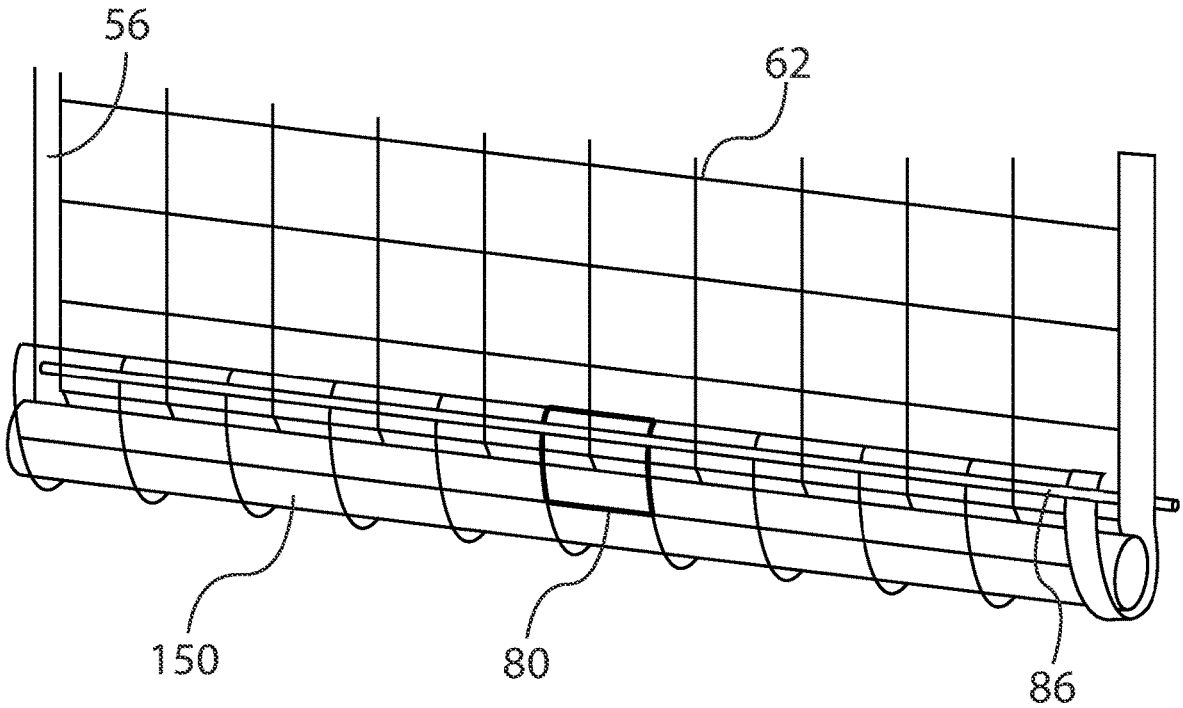
FIG. 21*a* is a front perspective view of one embodiment of a side weight integrated with the backstop of FIG. 1.
Figure 21B:
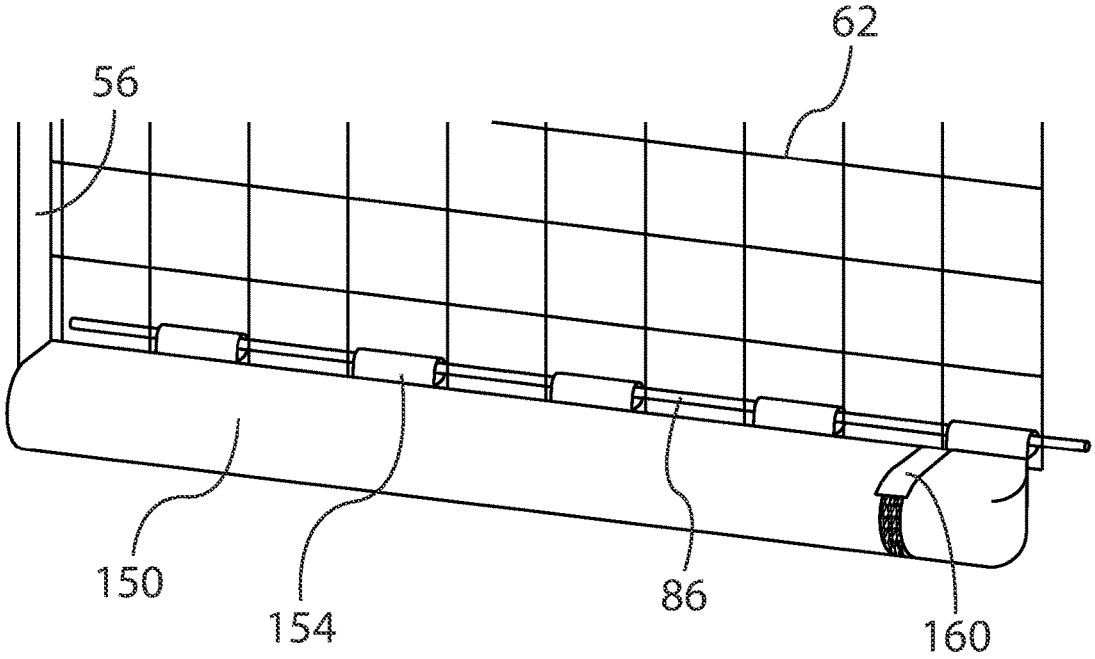
FIG. 21*b* is a front perspective view of an embodiment of a side weight of FIGS. 20*a-d* integrated with the back stop of FIG. 1.

Backstop 50 (50*a*, 50*b*, 50*c* and 50*d*), FIGS. 1-22, is for placement around a goal 52 having a goal height 54 to stop sport projectiles from traveling beyond an outer edge of the goal if the projectile misses the goal. Goal 52 has a frame 56 supporting a goal net 58. Goal net 58 has a goal net mesh 60. As shown in FIGS. 1-3, backstop 50 comprises a material implement 62. Material implement 62 has a top edge 64, side edges 66 and a bottom edge 68. Backstop 50 comprises a goal acceptance aperture 70 (70*a*, 70*b*) located within the material implement substantially central to bottom edge 68 and extending towards top edge 64. Backstop 50 further comprises an attachment mechanism 72 that secures material implement 62 to goal 52. Backstop 50 also comprises at least one bracket 90 operable to attach the backstop to goal frame 56. A at least one support structure 76 extends from each bracket 90 to support material implement 62 so that when the material implement is secured to goal 52 the material implement extends beyond the outer edge of the goal. The components making up two exemplary embodiments of backstop 50 are shown in FIGS. 4*a* and 4*b*.

Material implement 62 maybe at least one of a single and multi-piece system of fabric or fabric sections. In one embodiment material implement 62 may be a backstop net mesh having backstop net mesh openings 78. Backstop net mesh openings 78 may also act as lacing openings 80. In other embodiments, material implement could be made of a light weight material such as banner mesh materials formed from polyester or vinyl fibers. Material implement preferably has a reinforcing edge 82 along top edge 64 and side edges 66. Reinforcing edge 82 provides a strong attachment location for support structure 76 having a cap 144 and hook 146 attach to the reinforced edge.

Goal acceptance aperture 70 may be an opening 70*a* (FIG. 4*a*) or one or more slits 70*b* (FIG. 4*b*) within material implement 62 as used in backstop 50, 50*b*. Slits 70*b* extend towards top edge 64 from bottom edge 68. Slits 70*b* extend part way through material implement 62. Material implement 62 may exist between the slits, FIG. 4*b*. Adjacent opening 70*a* or slit 70*b*, near aperture edge 71, are provided lacing openings 80. Lacing openings 80 may be backstop net mesh openings 78. Lacing openings 80 may be openings within the fabric of material implement 62. Lacing openings 80 may also be closed loops of material secured to the edge of the goal acceptance aperture 70.

Attachment mechanism 72 may be a lacing system 84 (FIG. 5*a*) including lacing cord 86 for threading through any number of lacing openings 80 and goal net mesh 60 to secure material implement 62 to goal 52. Attachment mechanism 72 may also be a plurality of hooks 87 (FIG. 5*b*) attached to goal frame 56 and operable to attach material implement 62 to goal frame 56 by hooking the material implement directly to the hooks or lacing the material implement to the hooks using lacing cord 86. Attachment mechanism 72 may also be a net-to-net attachment mechanism (FIG. 5*c*) where the lacing system 84 includes a lacing cord 86 for threading through any number of lacing openings 80 between goal net mesh 60 to secure material implement 62 to goal 52. Attachment mechanism 72 may further be a closed loop attachment mechanism (FIG. 5*d*) where the lacing system 84 includes a lacing cord 86 for threading through any number of closed loops 154 on the edge of material implement 62 that are laced to goal net mesh 60 to secure material implement 62 to goal 52.

When a lacing cord 86 is used as part of the attachment mechanism 72, the lacing cord is preferably a polymeric tube or elastomeric tube, but may be a solid cord. The elastomeric tube preferably has an outer tube diameter, wherein a length equal to the outer diameter of the elastomeric tube can stretch or flex three to fifteen times the outer diameter. When lacing cord 86 is a tube, the lacing cord may also include the tube connectors. Connectors 88 (tube connectors or cord connectors) are used between sections of tube or cord to extend the length of the lacing cord. The connectors are also used to change cord types for different flexibility or other properties within a length of cord. The connectors are also used to add angled, T, X or Y connections to the tube or cord. Connectors 88 may be internal connectors, external connectors or other types of fittings.

Bracket 90, FIGS. 6-14, includes a body portion 92 having a top 94, a bottom 96 and a frame acceptance face 98. A channel 100 is located along the frame acceptance face 98 from top 94 to bottom 96. Channel 100 is for accepting goal frame 56 to which bracket 90 will be secured to. Body portion 92 has at least one stationary hook 102 adjacent a first side of channel 100 and an adjustable hook 104 adjacent the opposite side of the channel. Bracket 90 further includes a strap 106 running between station hook 102 and adjustable hook 104 to adjustably hold goal frame 56 securely within channel 100. In most embodiments, a pair of brackets 90 is preferred with one bracket for attachment to either side of goal frame 56. Brackets 90 are preferably ambidextrous brackets in that that can be used on both the right side and left side of goal frame 56 interchangeably. Although bracket 90 is shown for use in securing support structure 76 to goal frame 56, it is understood that this bracket may have uses in other sporting applications or even other fields outside of sporting.

Channel 100 may include both a tapered flange portion 108 and a recessed portion 110. Tapered flange portion 108 is for directly engaging goal frame 56. Recessed portion 110 is for accepting goal frame protrusions, such as net lacing bars, hooks, net fabric, etc. By providing a place for the goal frame protrusions to reside within, the flanged portion of channel 100 can make direct contact with goal frame 56 without being obstructed by the protrusions. In some embodiments, channel 100 is a v-shaped channel. In some embodiments, tapered flange portion 108 has a compliant insert 112 within the tapered flange to provide for a more compliant interface between bracket 90 and goal frame 56 that makes it less likely that the bracket will slip or turn during use.

Stationary hook 102 adjacent the first side of channel 100 may be a plurality of stationary hooks spaced along the first side. Stationary hooks 102 are sized to accept a looped portion of strap 106. Stationary hooks 102 are used for rough adjustment for connecting bracket 90 to different diameter goal frames 56. Strap 106 is looped over whichever stationary hook best fits the size goal frame that bracket 90 is being attached to. Adjustable hook 104 adjacent the opposite side of channel 100 is a hook element that is slidably engaged with adjustment channel 114 and has a worm gear 116 to slide the hook element along the adjustment channel, FIG. 14. When strap 106 is looped over adjustable hook 104, knob 118 is turned to move the adjustable hook along adjustment channel 114. Adjustable hook provides fine adjustment of the strap and determines the amount of force holding goal frame 56. Strap slot 117 may be provided between the channel and at least one stationary hook. Goal net slots 119 are for horizontal goal net strings to pass through, so they do not get pinched between compliant inserts 112 and goal frame 56.

Bracket 90 may further include struts 120 that reduce possible rotation of the bracket around the goal frame 56. Details of strut 120 are shown in FIGS. 15*a*-16*c*. Strut 120 includes an ambidextrous strut rod 122 having a first strut rod connection 124 extending on the bracket 90. Strut rod 122 has a strut rod length and is formed to fit a second strut rod connection 126. At second strut rod connection 126, a strut rod connector 128 is provided for connection to goal frame 56. Strut rod connector 128 has a frame engagement section 130 that can be secured to goal frame 56 with fasteners 132 such as zip ties. The shape of strut rod 122 is such as to allow for a connection of bracket 90 to goal frame 56 that is at 90-degrees to the frame to eliminate rotation around the goal frame. Bracket 90 and strut rod connector are engaged on both vertical and horizontal portions of goal frame 56.

One or more support structures 76 extend from each bracket to support material implement 62 so that the material implement that is secured to goal 52 extends beyond the outer edge of the goal. Support structure 76 may consist of a variety of support shapes that extend material implement upwards above goal 52 and outwards from the goals sides. Support structure 76 may be in the form of support rods. Support structure 76 may be a solid rod, a rod that is several pieces of rod that fit together, a hollow multi-piece rod with an elastic cord on the interior, etc. Support structure 76 may be fitted with a cushioning sleeve 77 on all or part of the exterior, the cushioning sleeve helps to soften the impact force from sport projectiles that may hit the support rod when the projectile misses goal 52. Cushioning sleeve 77 may be made of a resilient material such as a foam tube that is slipped over the support structure. Support structure 76 could be a single support structure, but is preferably a pair of support structures, one on each side of goal 52. In one embodiment, FIG. 17, support structure 76 is a T-shaped rod 134 extending from bracket 90. One support hole would be provided on the top of each bracket for holding support structure 76. In another embodiment, FIG. 1, support structure 76 is two rods, interior rod 136 and exterior rod 138. In this embodiment, interior rod 136 is secured in bracket 90 by interior rod support hole 140 and exterior rod support hole 142, respectively. Bracket 90 may have two support holes, one on each side of the channel to accommodate the support rods depending on whether the bracket is used as a right side bracket or a left side bracket. In this manner one bracket 90 can be both a right side bracket and a left side bracket, reducing the need for manufacturing two different types of brackets. At the end of each support structure 76 is a cap 144 and hook 146 that attaches to material implement 62, FIG. 18.

Backstop 50 is adaptable to fit various size goals via an adjustable side weight system, which is aided by the use of side weights 150, FIGS. 19*a*-22. Side weights 150 stretch and hold the side sections of material implement 62 to be in contact with the ground. When a sport projectile hits the sides of backstop 50, the side weights 150 keep the material implement from being pushed backwards. For goals of different goal height 54, side weights 150 may be attached at different heights of the side sections of material implement 62 to keep those sections taught. FIGS. 19*a*-19*d* illustrate how the same backstop 50 can be integrated to fit two different goals, respectively a lacrosse goal and a hockey goal.

In general, side weights 150 are elongated side weights. Side weights 150 have a weight length 152 with a plurality of side weight closed loops 154 disposed along the weight length. In one embodiment, FIGS. 20*a*-20*d*, side weight 150 is a removable weight 156 within a sleeve 158 having a sleeve length with lacing closed loops 154 attached along the length of the sleeve. Removable weight 156 can be securely held within sleeve 158 by folding the open end of the sleeve over and fastening the folded part with fastener 160. Fastener 160 may be Velcro®, a zipper, etc. In one embodiment, side weights 150 are attached by wrapping backstop net around the weight and lacing the backstop net mesh openings 78 with weight lacing cord 86, FIG. 21*a*. In another embodiment, side weights 150 can be attached by lacing closed loops 154 to the goal net mesh, FIG. 21*b* and FIG. 1. Generally, material implement 62 has a plurality of rows of lacing openings extending upward from the bottom edge towards the top edge. These lacing openings may be backstop net mesh openings 155, FIG. 1, or more general weight lacing openings 162 formed within the material implement of backstop (50, 50*d*), FIG. 22. Side weights 150 may be secured to any row of lacing openings 80 to secure the side weights to the material implement at varying heights above the bottom edge to match the goal height of the goal.

Figure 22:
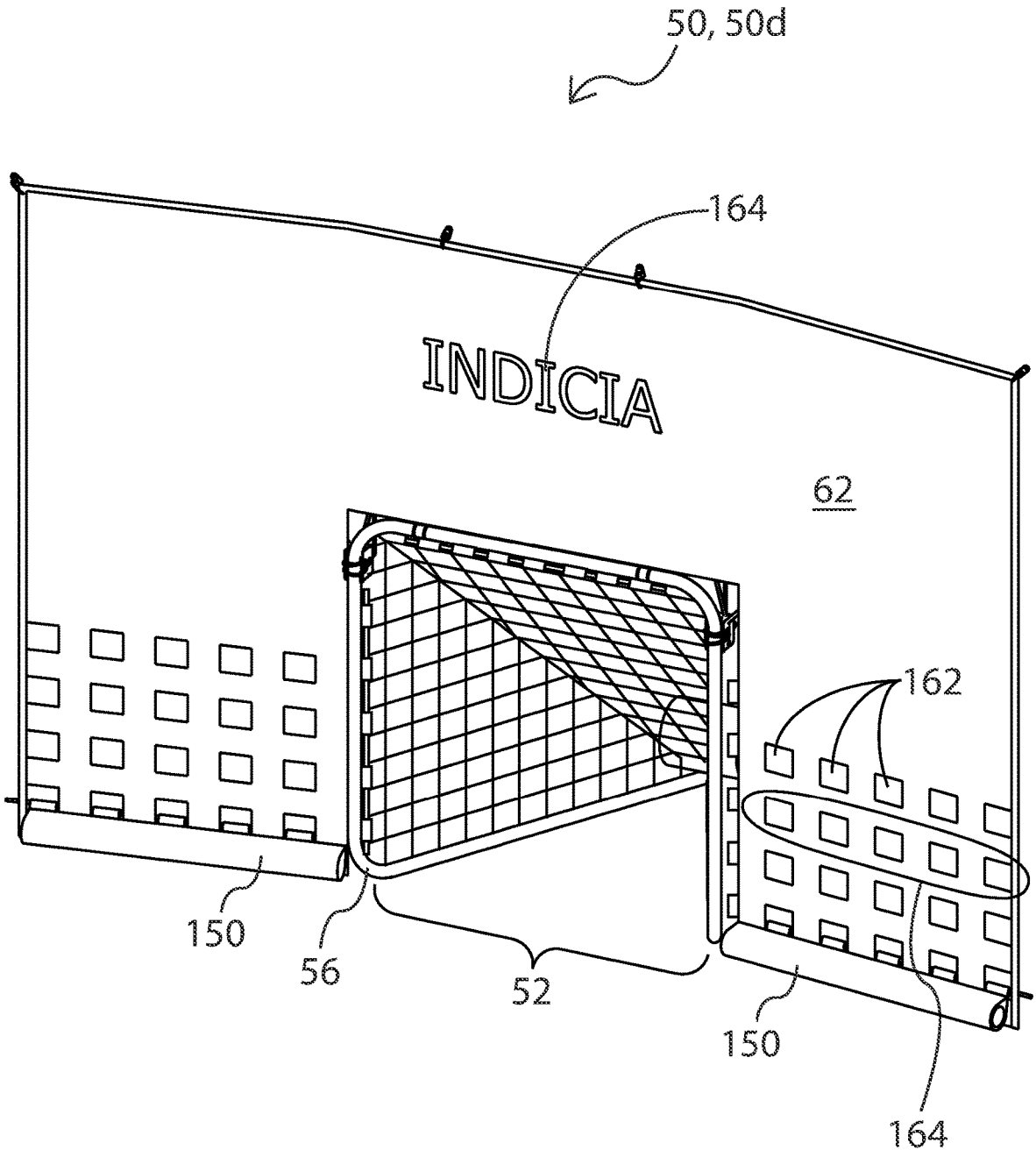
FIG. 22 is a front perspective view of an alternative embodiment of the backstop in FIG. 1 illustrating rows of lacing openings and an indicia on the material implement.

Depending on the type of fabric from which material implement is fabricated, indicia 164 may be provided for advertisement purposes on the backstop (50, 50*d*), FIG. 22.

Because backstop 50 has a large area when deployed, the backstop can act like a sail and have large wind forces imparted upon the backstop. Also, because the outer edges of the backstop 50 extend a great distance beyond goal 52, a sport projectile hitting the outer edges of the backstop may create large lever forces that can act to move or tip the goal if it is not tethered to the ground. To mitigate these circumstances, counter weight 166 as shown in FIGS. 2 and 3, may be provided to keep the backstop and goal structure stable. Alternatively, securing stakes 168 may also be used to secure the goal and backstop to the ground. Such a staking system may also include an elastic or silicone cord loop that can be wrapped around the lower corners of the net that is then be hooked to securing stakes 168. The cord helps absorb shock to the net and helps prevent the stake from pulling out of the ground.

An exemplary process for attaching backstop 50 to goal 52 is to first unwrap and lay all components out on the ground as shown in FIGS. 4*a* and 4*b*. Brackets 90 are then attached to each side of goal 52 on the goal frame 56 in the range of 4" to 6" below the crossbar, FIGS. 15*a* 15*b*. First, bracket strap 106 is fed through an opening in the goal's mesh netting strings, horizontal net strings fit through goal net slots 119 on bracket 90 so that the net strings do not become pinched between the compliant inserts 112 and goal post 56. Straps 106 are adjusted for proper fit to the goal frame diameter by hooking the strap to the appropriate stationary hook 102. The opposite strap end is looped around adjustable hook 104. Knob 118 is then turned to drive the worm gear 116 in the threaded slidable cleat nut 105 to draw strap 106 tight and pull bracket 106 firmly against goal frame 56. Optional struts 122 are secured in place by inserting one end of the strut into the center offset hole 115 in the back of the bracket 90. The opposite end of strut 122 locates the position of strut connector 128 on goal frame 56. Strut connector 128 is fastened with fasteners 132 at that location on the goal frame cross bar. Strut 122 is inserted into the female receiver of the strut connector 128. Exterior rods 138 with end caps 144 and hooks 146 are attached to each of the upper most corners of the material implement 62. Interior rods 136 attach to material implement 62 at the appropriate distance on the inner top edge. Support structures 76 (interior rods 136 and exterior rods 138) are then used to lift material implement 62 up so that the material implement is placed around the goal so that goal acceptance aperture 70 is fitted around the outer edge of the front of goal 52. Each of the exterior rod 138 bottom ends are then inserted into bracket 90 at their respective exterior rod support holes 142, which will stretch and hold the material implement in place up and around goal 52. Interior rods 136 are then inserted into the interior rod support holes 140 to support the middle upper edge portion of the material implement. Edges of acceptance aperture can be installed in three ways. 1) Aperture edge 71 is left to drape on the backside of the goal frame 52 on its netting. 2) Aperture edge 71 is draped in front of the goal frame 52 then attached by threading lacing cord 86 through the backstop mesh openings 78 and through goal net mesh 60 openings as to join the two materials. 3) Aperture edge 71 is draped behind the goal frame 52 and material implement 62 is attached by threading lacing cord 86 through backstop mesh openings 78 and through goal net mesh 60 openings as to join the two materials. Lacing cord 86 is passed through lacing openings 80 of the backstop and goal net mesh 60 of goal 52. Side weights 150 are then laced at the appropriate height on each side of goal 52. Optional counter weight 166 is deployed to rest on top of the back side of goal 52 or goal net.

While several embodiments of the invention, together with modifications thereof, have been described in detail herein and illustrated in the accompanying drawings, it will be evident that various further modifications are possible without departing from the scope of the invention. The scope of the claims should not be limited by the preferred embodiments set forth in the examples, but should be given the broadest interpretation consistent with the description as a whole.

What is claimed is:

1. A backstop for placement around a goal having a goal height to stop sport projectiles from traveling beyond an outer edge of the goal, the goal having a frame supporting a goal net, the goal net having a goal net mesh; comprising:

a) a material implement, wherein the material implement has a top edge, side edges and a bottom edge;

b) a goal acceptance aperture located within the material implement at the bottom edge and extending towards the top edge;

c) an attachment mechanism that secures the material implement to the goal;

d) at least one bracket operable to attach to the goal frame;

e) a support structure extending from the at least one bracket operable to support the material implement to extend beyond the outer edge of the goal; and f) wherein the at least one bracket includes a body portion having a top, a bottom and a frame acceptance face; a channel located along the frame acceptance face from the top to bottom for accepting the frame; at least one stationary hook adjacent a first side of the channel; an adjustable hook adjacent an opposite second side of the channel; and a strap running between the stationary hook and the adjustable hook to adjustably hold the frame securely within the channel.

2. The backstop as recited in claim 1, wherein the material implement includes at least one of a single and a multi piece system of fabric or fabric sections.

3. The backstop as recited in claim 1, wherein the attachment mechanism is a plurality of hooks operable to attach the material implement to the goal frame.

4. The backstop as recited in claim 1, wherein the goal acceptance aperture has a goal acceptance aperture edge having lacing openings.

5. The backstop as recited in claim 4, wherein the attachment mechanism is a lacing cord for threading through any number of the lacing openings and the goal net mesh to secure the material implement to the goal net.

6. The backstop as recited in claim 1, wherein the material implement is a backstop net mesh having backstop mesh openings, wherein the backstop mesh openings are lacing openings.

7. The backstop as recited in claim 6, wherein the attachment mechanism is a lacing cord for threading through any number of the lacing openings and the goal net mesh to secure the material implement to the goal net.

8. The backstop as recited in claim 1, further comprising a reinforced edge around the top and side edges of the material implement.

9. The backstop as recited in claim 1, further comprising side weights having a weight length with a plurality of closed loops disposed along the weight length.

10. The backstop as recited in claim 9, wherein the side weights are elongated side weights.

11. The backstop as recited in claim 9, wherein the side weight is a weight within a sleeve.

12. The backstop as recited in claim 9, wherein the material implement has a plurality of rows of lacing openings extending upward from the bottom edge towards the top edge; further including a weight lacing cord for threading through any number of the closed loops and a row of lacing openings to secure the side weights to the material implement at varying heights above the bottom edge to match the goal height of the goal.

13. The backstop as recited in claim 1, further comprising a counter weight to keep the backstop from tipping.

14. The backstop as recited in claim 1, wherein the support structure is two rods extending upward from the bracket to the edge of the material implement.

15. The backstop as recited in claim 1, wherein the support structure is a T-shaped bar to support any of the edges of the material implement.

16. The backstop as recited in claim 1, wherein the channel has a tapered flange portion and a recessed portion.

17. The backstop as recited in claim 16, wherein the tapered flange portion has a compliant insert within the tapered flange.

18. The backstop as recited in claim 1, wherein the channel is a v-shaped channel.

19. The backstop as recited in claim 1, wherein the adjustable hook is a hook element slidably engaged with an adjustment channel and having a worm gear to slide the hook element along the adjustment channel.

20. The backstop as recited in claim 1, further comprising at least one support hole for holding a support rod.

21. The backstop as recited in claim 20, wherein the support hole is two holes, one on each of the top and bottom.

22. The backstop as recited in claim 20, wherein the support hole is two holes, one on either side of the channel.

23. The backstop as recited in claim 1, further comprising strap slots between the channel and the at least one stationary hook.

24. The backstop as recited in claim 1, further comprising a strut.

25. A backstop for placement around a goal to stop sport projectiles from traveling beyond an outer edge of the goal, the goal having a frame supporting a goal net, the goal net having a goal net mesh; comprising:

a) a material implement, wherein the material implement has a top edge, side edges and a bottom edge;

b) a goal acceptance aperture located within the material implement at the bottom edge and extending towards the top edge, c) at least one bracket operable to attach to the goal frame;

d) a support structure extending from each bracket operable to extend the material implement beyond the outer edge of the goal;

e) an attachment mechanism operable to secure the material implement to the goal; and f) an adjustable side weight system including one or more side weights, each side weight within a sleeve, the sleeve having a sleeve length with a plurality of lacing closed loops disposed along the sleeve length, each side weight attachable via a lacing cord that passes through the lacing closed loops to attach the one or more side weights to the material implement at different heights above the bottom edge on either side of the goal acceptance aperture to allow the material implement to fit different size goals.

26. The backstop as recited in claim 25, further comprising the lacing cord for threading between any number of the lacing closed loops and the goal net mesh.

27. A bracket for attachment to a frame; comprising:

a) a body portion having a top, a bottom and a frame acceptance face;

b) a channel located along the frame acceptance face from the top to bottom for accepting the frame;

c) at least one stationary hook adjacent a first side of the channel;

d) an adjustable hook adjacent an opposite second side of the channel; and e) a strap running between the stationary hook and the adjustable hook to adjustably hold the frame securely within the channel.

28. The bracket as recited in claim 27, wherein the channel has a tapered flange portion and an acceptance portion.

29. The bracket as recited in claim 27, wherein the tapered flange portion has a compliant insert within the tapered flange.

30. The bracket as recited in claim 27, wherein the channel is a v-channel.

31. The bracket as recited in claim 27, wherein the adjustable hook is a hook element slidably engaged with an adjustment channel and having a worm gear to slide the hook element along the adjustment channel.

32. The bracket as recited in claim 27, further comprising at least one support hole for holding a support rod.

33. The bracket as recited in claim 32, wherein the support hole is two holes, one on each of the top and bottom.

34. The bracket as recited in claim 32, wherein the support hole is two holes, one on either side of the channel.

35. The bracket as recited in claim 27, further comprising strap slots between the channel and the at least one stationary hook.

36. The bracket as recited in claim 27, further comprising a strut.

* * * * *